United States Patent [19]

Takahashi et al.

[11] Patent Number: 5,072,823

[45] Date of Patent: Dec. 17, 1991

[54] TRANSFER METHOD AND DEVICE AND DRIVING SYSTEM THEREFOR FOR TRANSFER PRESSES

[75] Inventors: Yoshio Takahashi; Mitsuo Sudo, both of Yokohama; Takamasa Arikawa, Kawasaki; Kenji Nakamura, Kamakura; Izumi Sato, Yokosuka; Katsuyuki Onogi, Yokohama; Takao Iura, Yokosuka; Nobuji Ishida, Yokohama, all of Japan

[73] Assignee: Ishikawajima-Harima Jukogyo Kabushiki Kaisha, Tokyo, Japan

[21] Appl. No.: 544,847

[22] Filed: Jun. 27, 1990

Related U.S. Application Data

[62] Division of Ser. No. 260,449, Oct. 20, 1988, Pat. No. 4,995,505.

[30] Foreign Application Priority Data

| | | | |
|---|---|---|---|
| Oct. 31, 1987 | [JP] | Japan | 62-276589 |
| Nov. 13, 1987 | [JP] | Japan | 62-287011 |
| Nov. 20, 1987 | [JP] | Japan | 62-177370[U] |
| Nov. 20, 1987 | [JP] | Japan | 62-177372[U] |
| Nov. 20, 1987 | [JP] | Japan | 62-177373[U] |
| Nov. 20, 1987 | [JP] | Japan | 62-293203 |
| Dec. 19, 1987 | [JP] | Japan | 62-198888[U] |
| May 9, 1988 | [JP] | Japan | 63-112090 |

[51] Int. Cl.[5] ..... B65G 25/04

[52] U.S. Cl. ..... 198/468.4; 198/468.01

[58] Field of Search ..... 198/468.01, 468.2, 468.3, 198/468.4, 468.6, 678.1; 414/752

[56] References Cited

U.S. PATENT DOCUMENTS

| | | | |
|---|---|---|---|
| 3,209,923 | 10/1965 | Bargel et al. | 198/468.3 X |
| 3,363,779 | 1/1968 | Matsushima | 414/752 X |
| 3,960,276 | 6/1976 | Gerhardt | 414/752 X |
| 3,970,191 | 7/1976 | Oldfield et al. | 198/468.6 X |
| 4,182,442 | 1/1980 | Jones | 198/468.2 X |
| 4,228,993 | 10/1980 | Lathers | 198/468.4 X |
| 4,407,630 | 10/1983 | Toda | 198/468.4 X |
| 4,658,626 | 4/1987 | Yamada et al. | 198/468.3 X |
| 4,688,668 | 8/1987 | Ookubo et al. | 414/752 X |
| 4,822,236 | 4/1989 | Inoue et al. | 198/468.4 X |

FOREIGN PATENT DOCUMENTS

| | | | |
|---|---|---|---|
| 2438960 | 2/1976 | Fed. Rep. of Germany | 414/752 |
| 2439032 | 2/1976 | Fed. Rep. of Germany | 414/752 |

*Primary Examiner*—Robert P. Olszewski
*Assistant Examiner*—James R. Bidwell

[57] ABSTRACT

A trolley is reciprocally moved along a guide. A work support, supported by the trolley, is vertically moved so that the lift mechanism can be made compact in size, or light weight and highly reliable in operation. Accordingly, the processing speed of the processing line is increased and the productivity is improved.

4 Claims, 31 Drawing Sheets

TRANSFER METHOD AND DEVICE AND DRIVING SYSTEM THEREFOR FOR TRANSFER PRESSES

This is a division of application Ser. No. 07/260,449, filed Oct. 20, 1988, now U.S. Pat. No. 4,995,505.

BACKGROUND OF THE INVENTION

The present invention relates to a transfer method and device and a driving system therefor for transfer presses.

Prior to the detailed description of the present invention, a conventional transfer device will be described with reference to FIGS. 1 and 2 so as to point out the technical problems thereof which the present invention contemplates to solve. A pair of vertically movable frames 1 and 2 (to be referred to as "lift frames" hereinafter in this specification for brevity) are disposed on both sides of an die array comprising a plurality of dies and extend in the direction of the processing line in parallel with each other. A plurality of movable stands 3 and 4 which can move in the direction of the processing line are mounted on the lift frames 1 and 2 and interconnected such that the distance between the adjacent pairs of movable stands 3 and 4 is maintained substantially equal to the distance between the adjacent die or processing stations and the movable stands 3 and 4 are drivingly coupled to a driving system (not shown) such that they are reciprocable in the direction of the processing line. A pair of supporting stands 5 and 6 which are reciprocably movable toward or away from each other in the direction of the processing line are mounted on the pair of movable stands 3 and 4 and cross bars 7 and 8 are mounted on the opposing supporting stands 5 and 6, respectively. A plurality vacuum cups 9 which can releasably suck a blank sheet are mounted on the cross bars 7 and 8. Reference numeral 10 represents pressed works.

With the transfer device with the above-described construction, after the works 10 have been pressed at the upstream die station A, the lift frames 1 and 2 are upwardly moved; while the cross bars 7 and 8 which were maintained at the retracted positions adjacent to the intermediate position C are moved away from each other, the movable stands 3 and 4 are moved to the station A. Thereafter the lift frames 1 and 2 are downwardly moved to lower the cross bars 7 and 8 toward the works 10 at the station A and then the vacuum cups 9 are activated to make the works 10 abut on the cross bars 7 and 8. Next the lift frames 1 and 2 are upwardly moved and the movable stands 3 and 4 are moved in the downstream direction to transfer the works 10 to the downstream die station B. Then the lift frames 1 and 2 are lowered and the vacuum cups 9 are released so that the works 10 are lowered and placed at the downstream station B. Thereafter the lift frames 1 and 2 are again upwardly moved; while the cross bars 7 and 8 are caused to move toward each other, the movable stands 3 and 4 are moved back to the intermediate position C. Then the lift frames 1 and 2 are lowered while the cross bars 7 and 8 are retracted, the works 10 being further pressed at the downstream die position B.

As described above, in response to the periodic actions of the lift frames 1 and 2, the movable stands 3 and 4 and the supporting stands 5 and 6, the cross bars 7 and 8 are caused to move vertically, transfer the works 10 and move toward or away from each other so that all the works 10 are sequentially transferred in the downstream direction and automatically pressed at a plurality of die or processing stations.

The transfer device with the above-described construction includes, as best shown in FIG. 3, a first driving device for vertically moving the lift frames 1 and 2, a second driving device for reciprocating the movable stands 3 and 4 in the direction of the process line and a third driving device for reciprocating the supporting stands 5 and 6 in synchronism with the movement of the movable stands 3 and 4 and causing them to move toward or away from each other on the movable stands 3 and 4. Thus, a driving system for driving the transfer device comprises the first, second and third driving devices. More specifically, the first driving device for vertically moving the lift frames 1 and 2 comprises a horizontal rack 11 which is drivingly coupled to a power source (not shown) for its horizontal movement, a pinion 12 in mesh with the horizontal rack 11 and a vertical rack 13 in mesh with the pinion 12 with the upper end thereof being securely joined to the lift frame 1 or 2, whereby the lift frames 1 and 2 are vertically movable through the pinion 12 and the vertical rack 13 by the horizontal movement of the rack 11.

The second driving device for driving the movable stands 3 and 4 comprises a carriage 15 which is located at one end of the lift frames 1 and 2, connected to the movable stands 3 and 4 through a connecting rod 14 and is reciprocable in the direction of the processing line and a feed lever 20 whose upper portion is vertically slidable in a vertical groove 16 formed in the carriage 15, and which is pivoted about a pivot pin 17 and carries a cam follower 18 at its lower end in contact with a feed cam 19 so that when the feed cam 19 is driven, the feed lever 20 is caused to pivot about the pivot pin 17 with its upper portion being slided along the groove 16. The swinging movement of the feed lever 20 is translated into the movement of the carriage 15 in the direction of the processing line, whereby the movable stands 3 and 4 can be driven.

The third driving device for causing the supporting stands 5 and 6 on the movable stands 3 and 4 to be movable in the direction of the processing line, thereby causing the cross bars 7 and 8 to move toward or away from each other, comprises a cam plate 27 attached securely to the lift frames 1 and 2 and having closed-loop-like cam surface means consisting of a downwardly directed cam surface 21, a reversal cam surface 22, an upwardly inclined cam surface 23, an upwardly directed cam surface 24, an upwardly inclined cam surface 25 and a second reversal cam surface 26; an inverted-T-shaped lever 33 which is pivoted at a midpoint between its lower ends to the carriage 15 with a pivot pin 28, has at its one lower end a cam follower 29 in rolling contact with the above-described closed-loop-like cam surface means (21–26) and a bias cylinder 30 at the other lower end for pressing the cam follower 29 against the cam surfaces 21–26 and is connected to a pushing-pulling rod 32 whose one end is slidable in an arcuate groove 31 formed through the upper end portion as will be described in more detail hereinafter, and said push-pull rods 32 which extend through the movable stands 3 and 4 such that they are reciprocable in the direction of the process line, thereby imparting the driving force to the supporting stand 5 and to the supporting stand 6 through a rack 34, a pinion 35 and a horizontal rack 36, whereby the swinging movement in the direction of the processing line of the lever 33 in unison with the carriage 15 is translated into the movement of the push-pull rods 32 in the direction of the processing line, thereby causing the supporting stands 5 and 6 on the movable stands 3 and 4 movable in the direction of the processing line to move toward or away from each other so that the cross bars 7 and 8 are also forced to move toward or away from each other.

A cylinder 37 changes the displacement of the push-pull rod 32 when the pivotal point of the push-pull rod 32 with respect to the lever 33 is changed to swing the lever 33.

The above-described transfer method and device and a driving system therefor for transfer presses have various technical problems. Firstly, great driving force is required for vertically moving the lift frames 1 and 2 which are long in length and heavy in weight. Furthermore, it is impossible to increase the speed of the processing line for improvement of the productivity since such speed increase would cause vibrations or oscillations of the lift frames 1 and 2 which are long in length and very heavy in weight when the works 10 are being transferred, resulting in dropping of the works 10 from the vacuum cups 9. Moreover, stroke of the cross bars 7 and 8 cannot be increased by the cam plate 27 because of the complicated construction of the cam plate 27 for causing the bars 7 and 8 to move toward or away from each other.

In view of the above, a primary object of the present invention is to make the lift component parts of a transfer device compact in size and light in weight, thereby decreasing the driving force, preventing vibrations or oscillations and making a transfer driving system simple in construction.

DETAILED DESCRIPTION OF THE PREFERRED EMBODIMENTS

First Embodiment

Figure 1:
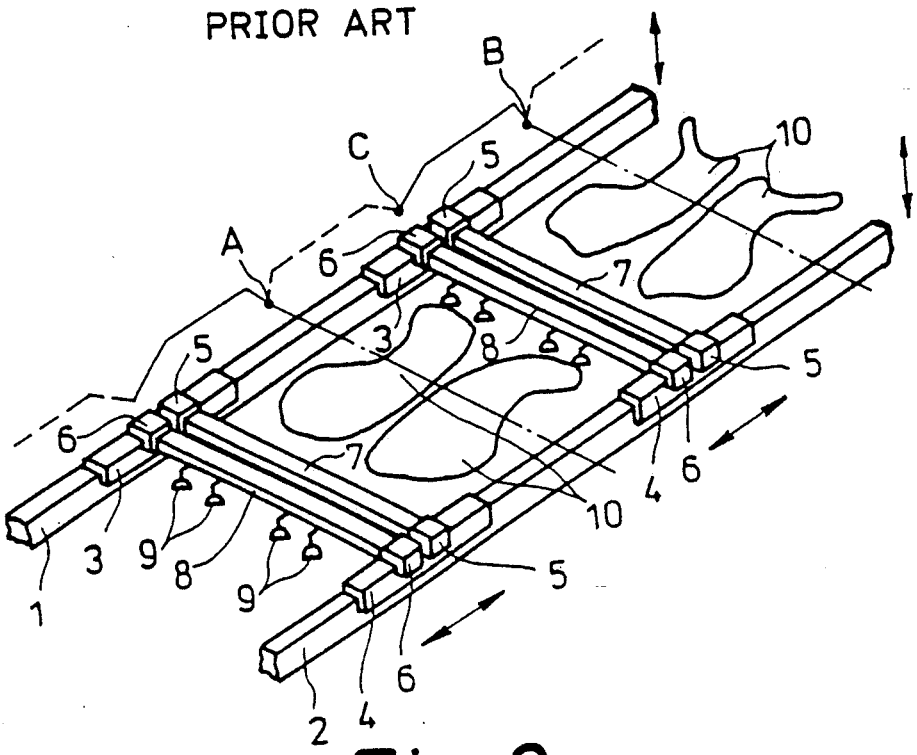
Fig. 1 PRIOR ART
FIG. 1 is a perspective view of a conventional transfer device for transfer presses.
Figure 2:
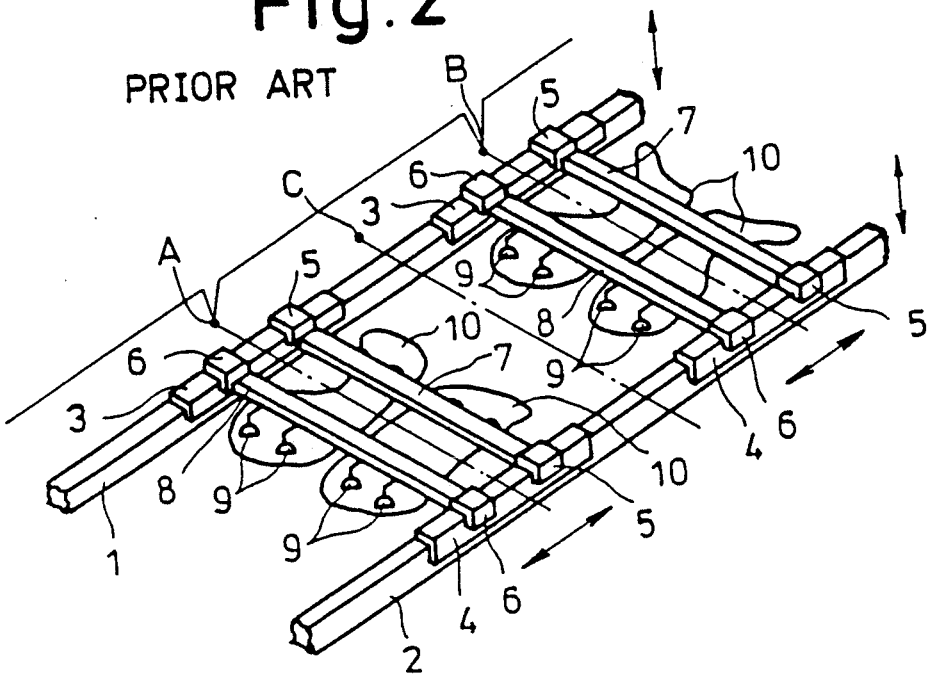
Fig. 2 PRIOR ART
FIG. 2 is a view used to explain the mode of operation thereof.
Figure 3:
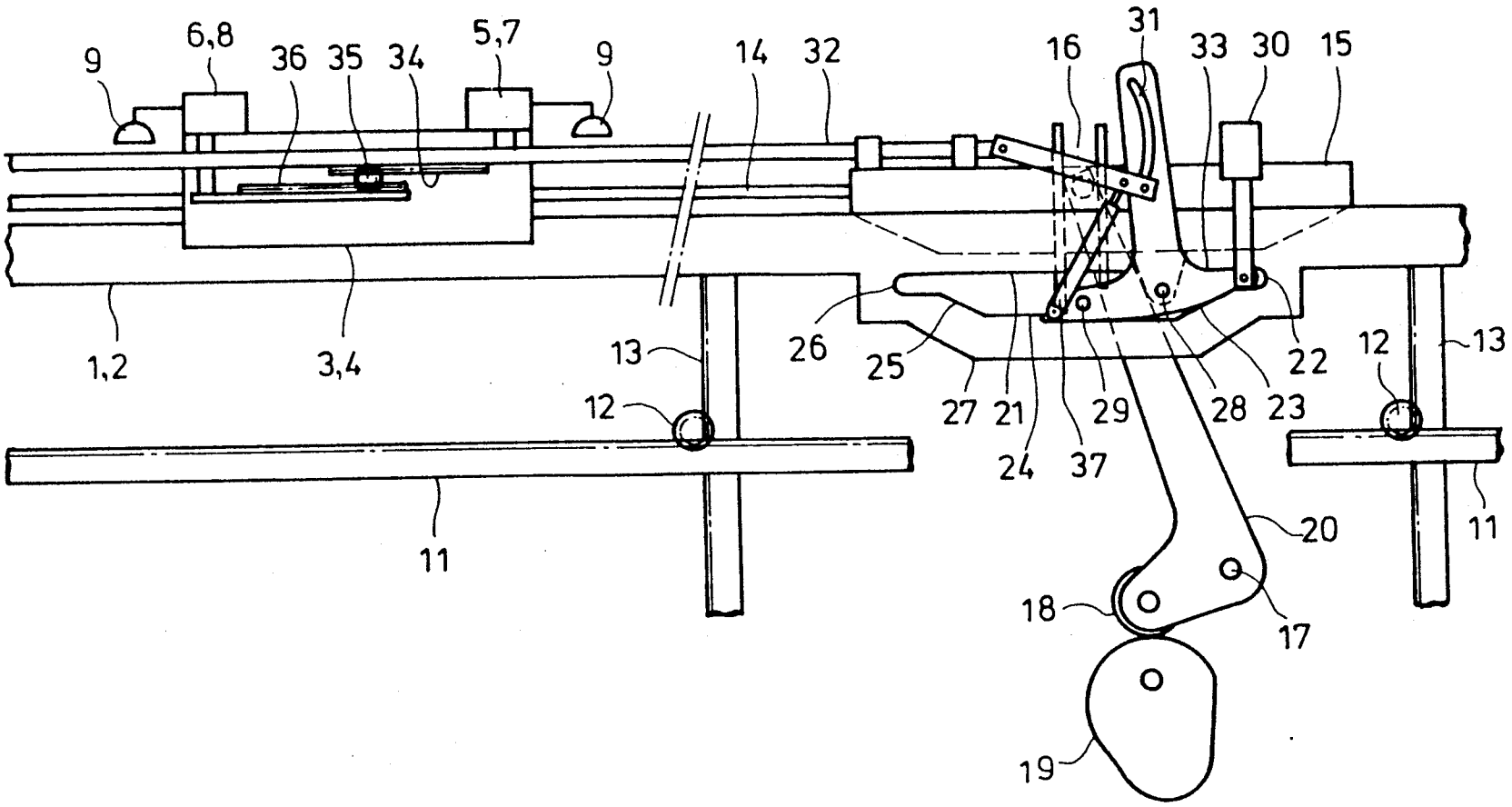
Fig. 3 PRIOR ART
FIG. 3 is a side view of a transfer driving system of the transfer device shown in FIG. 1.
Figure 4:
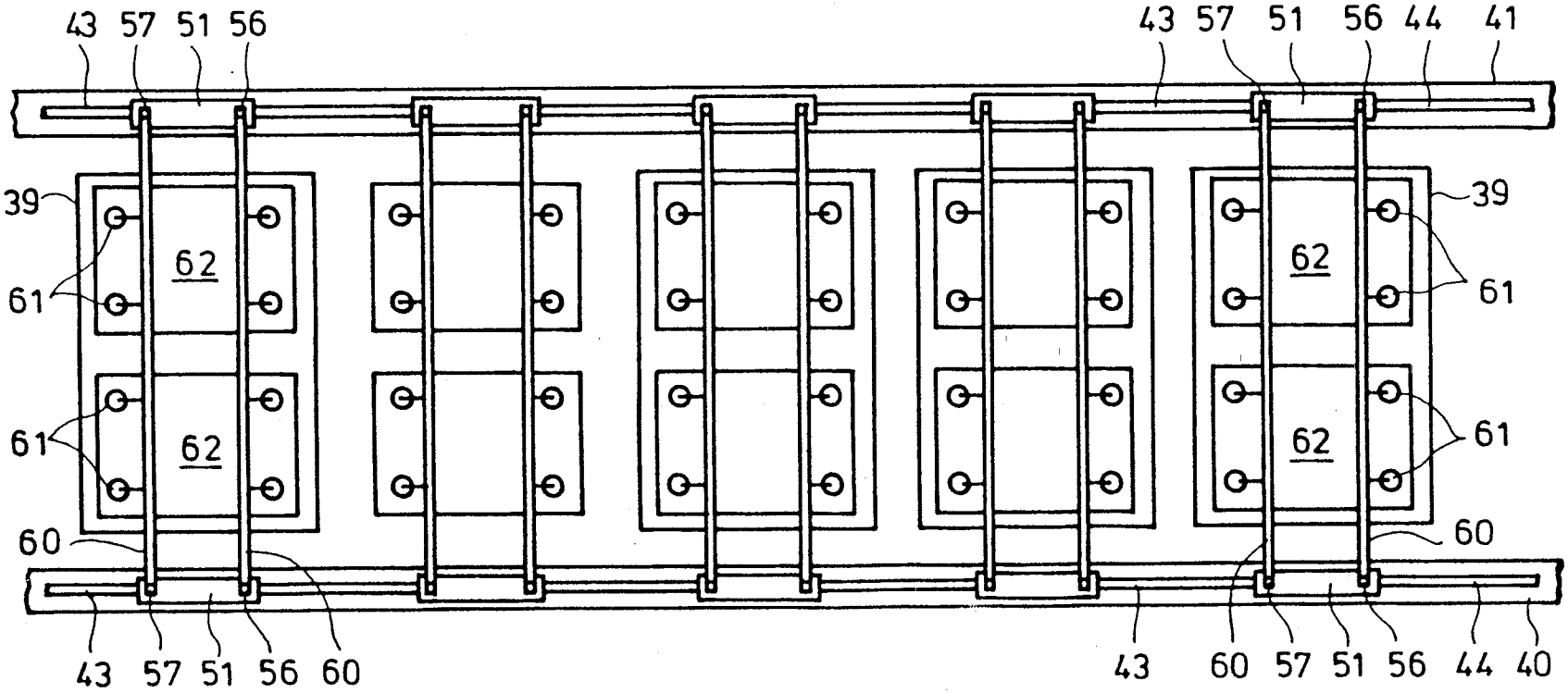
FIG. 4 is a top view of a first preferred embodiment of a transfer device in accordance with the present invention.
Figure 5:
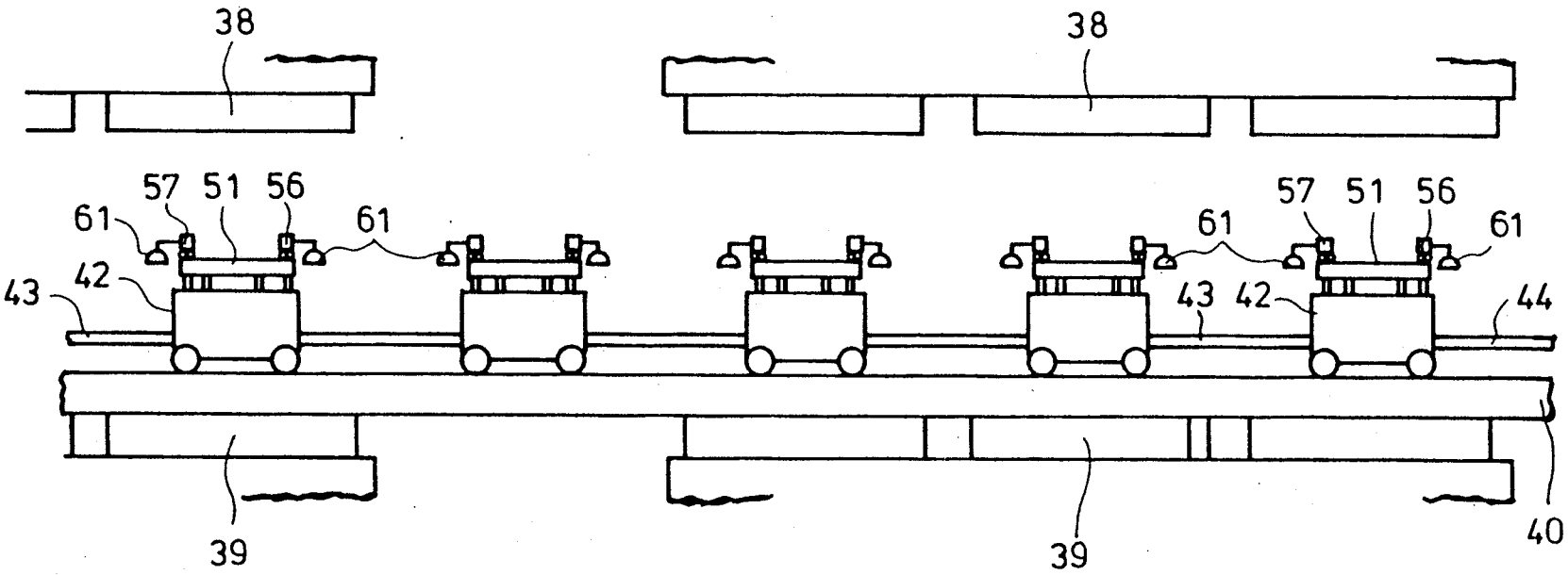
FIG. 5 is a side view thereof.
Figure 6:
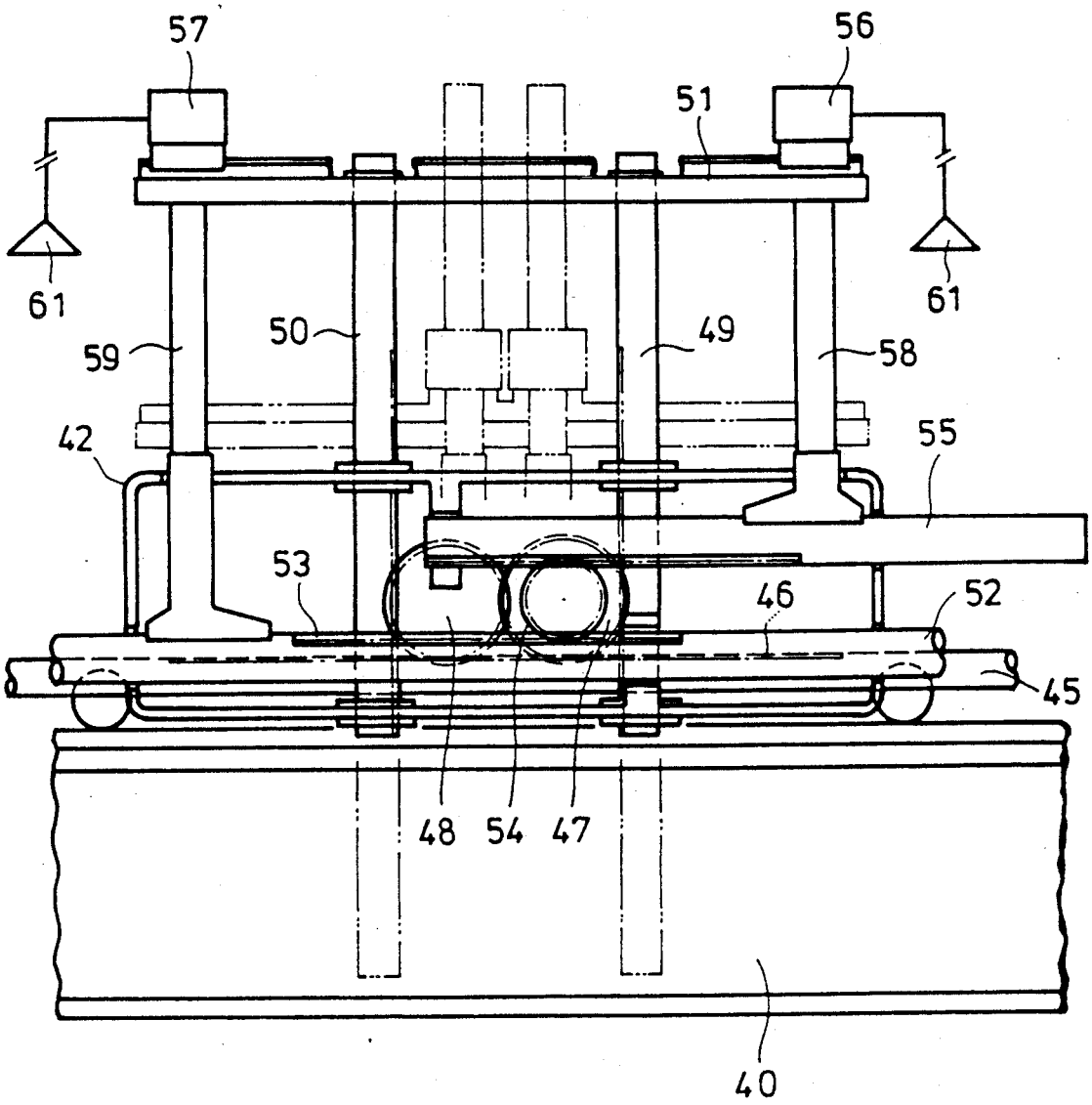
FIG. 6 is a view on enlarged scale of a trolley shown in FIG. 4.
Figure 7:
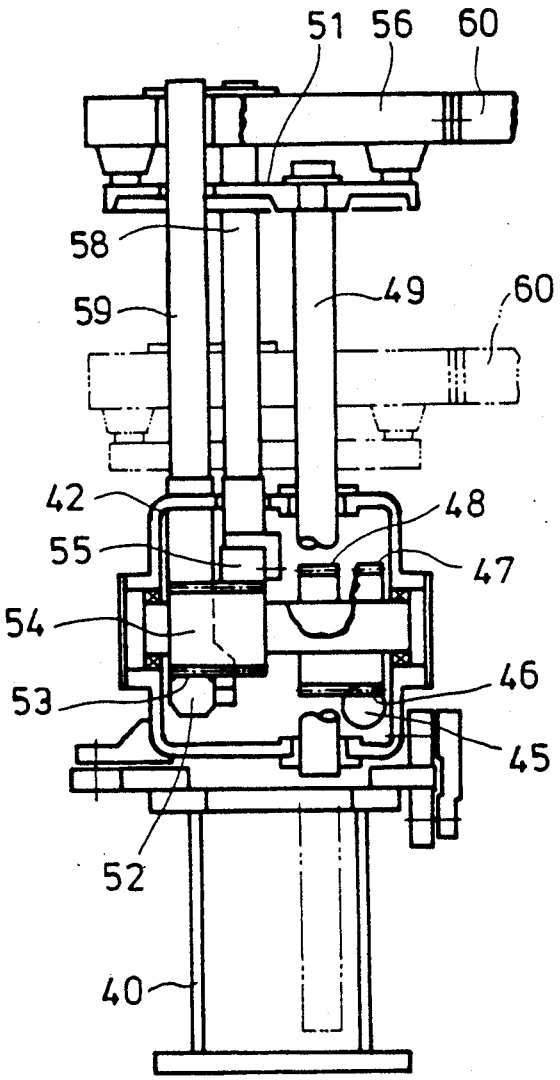
FIG. 7 is a front view thereof.
Figure 8:
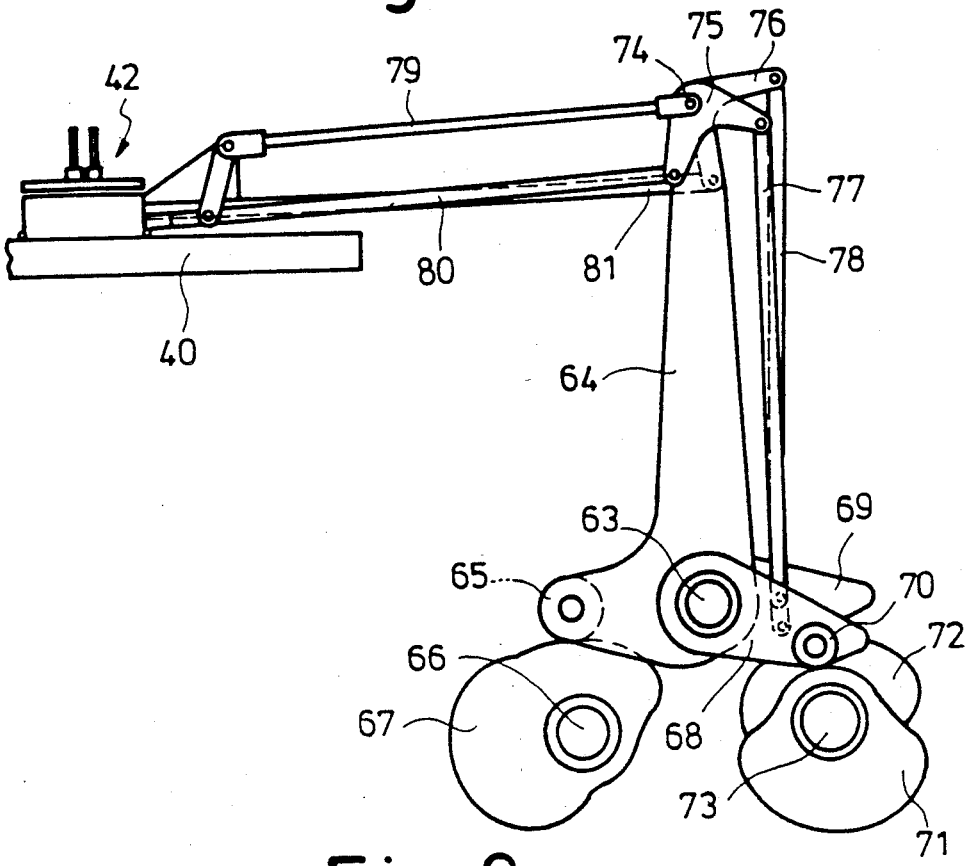
FIG. 8 is a side view of a transfer driving device used in the first embodiment shown in FIG. 4.

In the following description, the term "distance adjustment . . ." such as distance adjustment bar, distance adjustment lever are used to define parts used in a mechanism for causing a pair of cross bars 60 to move toward or away from each other, thereby adjusting the distance therebetween.

Referring now to FIGS. 4–9, a first preferred embodiment of the present invention will be described. A plurality of sets of upper and lower dies 38 and 39 are disposed and spaced apart from each other in the direction of the processing line and a pair of parallel guides 40 and 41 extend along either side of the processing line. A plurality of trolleys 42 which are movable in the direction of the processing line are mounted on each guide 40 (41) and are interconnected by means of connecting bars 43 such that the distance between the adjacent trolleys 42 is maintained substantially equal to the distance between the adjacent upstream and downstream die sets 38 and 39. The most upstream or downstream trolley 42 is connected through a transfer bar 44 to a transfer driving system (that is, a system for driving a transfer device in accordance with the present invention) to be described below so that in response to the reciprocal motion of the transfer bar 44 in the direction of the processing line, all the interconnected trolleys 42 are reciprocated in the direction of the processing line simultaneously.

A lift bar 45 which is reciprocated in the direction of the processing line by the transfer driving system to be described below slidably extends through each trolley 42 and a portion of the lift bar 45 which is located within the trolley 42 is formed with a rack 46; a pinion 47 in mesh with the rack 46 and a pinion 48 in mesh with the pinion 47 but in not mesh with the rack 46 are rotatably mounted with the trolley 42. Vertical racks 49 and 50 in mesh with the pinions 47 and 48, respectively, vertically extend through the trolley 42 and beyond the top thereof.

A guide plate 51 which extends in the direction of the processing line is securely joined to the upper ends of the vertical racks 49 and 50 such that it is vertically moved in unison with the reciprocal motion of the lift bar 45 in the direction of the processing line.

A distance adjustment bar 52 which is reciprocated in the direction of the processing line by the transfer driving system to be described below is slidably extended through the trolley 42 and a portion of the bar 52 located within the trolley 42 is formed with a rack 53, a pinion 54 in mesh with the rack 53 being rotatably mounted within the trolley 42. A horizontal rack 55 in mesh with the pinion 54 is mounted within the trolley 42 such that the rack 55 is movable in the direction of the processing line. Two supporting stands 56 and 57 are mounted on the guide plate 51 such that they are movable in the direction of the processing line. One supporting stand 56 is supported by the upper end portion of a vertical rod 58 which slidably extends through the stand 56 and the lower end of the vertical rod 58 is securely joined to the horizontal rack 55. The other supporting stand 57 is supported by the upper end portion of a vertical rod 59 which slidably extends through the stand 57 and the lower end of the vertical rod 59 is securely joined to the distance adjustment bar 52. Thus, in response to the reciprocal motion of the distance adjustment bar 52 in the direction of the processing line, the supporting stands 56 and 57 are caused to move toward or away from each other through the pinion 54, the horizontal rack 55 and the vertical rods 58 and 59.

Work supporting means such as cross bars 60 extend between the opposing supporting stands 56 and 57 on the guides 40 and 41 and work clamping or holding means such as vacuum cups 61 adapted to releasably suck the works are attached to each cross bar 60 at height corresponding to the height of the upper and lower dies 38 and 39 as well as the works 62.

Figure 9:
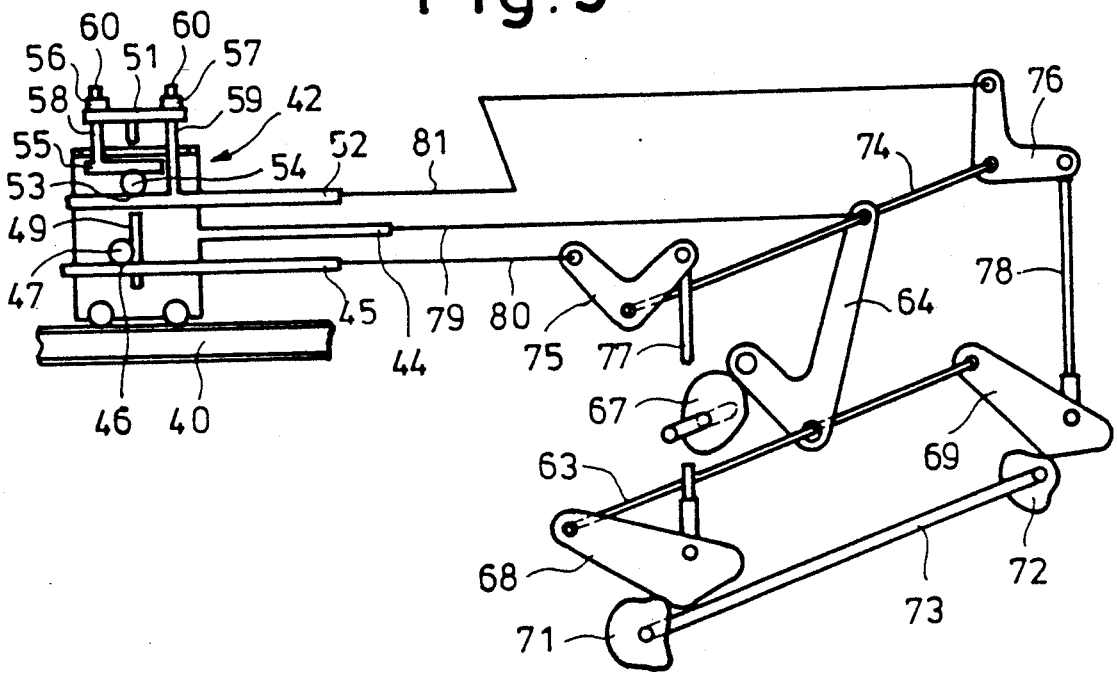
FIG. 9 is an exploded perspective view thereof.

The transfer driving system has the following construction. An L-shaped transfer lever 64 which is pivoted with a pivot pin 63 so as to be swingable in the direction of the processing line has at its lower end a cam follower 65 which in turn is made into contact with the cam profile surface of a transfer cam 67 carried by a cam shaft 66 so that upon rotation of the transfer cam 67, the transfer lever 64 is caused to swing about the pivot pin 63 through the cam follower 65. As best shown in FIG. 9, one end of a lift lever 68 and a distance adjustment lever 69 are rotatably attached to the pivot pin 63 and the other ends of the levers 68 and 69 carry cam followers 70, respectively, which in turn are pressed against a lift cam 71 and a distance adjustment cam 72, respectively, carried by a cam shaft 73. A horizontal shaft 74 extends through the upper end portion of the transfer lever 64 and a V-shaped lift rocker 75 is rotatably carried by one end of the horizontal shaft 74 while a V-shaped distance adjustment rocker 76 is rotatably carried by the other end of the horizontal shaft 74. A lift rod 77 which is in parallel with and equal in length to the line interconnecting between the pivot shaft 63 and the horizontal shaft 74 has its upper and lower ends pivoted to one end of the transfer rocker 75 and to a point between the ends of the lift lever 68, respectively, whereby a parallelogram linkage is defined. In like manner, the upper and lower ends of the distance adjustment rod 78 are pivoted to one end of the distance adjustment rocker 76 and a point between the ends of the distance adjustment lever 69, whereby a parallelogram linkage is also defined. Therefore when the transfer cam 67 swings the transfer lever 64, the lift rocker 75 can swing independently through the lift cam 71, the lift lever 68 and the lift rod 77 while the distance adjustment rocker 76 can also swing independently through the distance adjustment cam 72, the distance adjustment lever 69 and the distance adjustment rod 78.

The upper end of the transfer lever 64 is connected to the downstream end of the transfer bar 44 by a connecting rod 79; alternatively, without the transfer bar 44, it may be directly connected to the most upstream or downstream trolley 42. The other end of the lift rocker 75 is connected to the downstream end of the lift bar 45 by a connecting rod 80. The other end of the distance adjustment rocker 76 is connected to the downstream end of the distance adjustment bar 52 by a connecting rod 81.

Next the mode of operation of the first embodiment with the above-described construction will be described. When the transfer cam 67 swings the transfer lever 64, the connecting rod 79 and the transfer bar 44 are moved in the direction of the processing line so that the trolleys 42 interconnected by the connecting bars 43 in the manner described above are caused to reciprocate in unison in the direction of the processing line.

When the lift cam 71 swings the lift lever 68 with respect to the transfer lever 64 while the lever 64 is swinging, the lift rocker 75 is caused to swing through the lift rod 77 so that the connecting rod 80 and the lift bar 45 are caused to move in the direction of the processing line with respect to the transfer bar 44 and consequently the cross bars 60 are vertically moved through the pinions 47 and 48, the vertical racks 49 and 50 and the guide plate 51.

In like manner, when the distance adjustment cam 72 causes the distance adjustment lever 69 to swing with respect to the transfer lever 64 while the lever 64 is swinging, the distance adjustment rocker 76 is caused to swing through the distance adjustment rod 78 so that the connecting rod 81 and the distance adjustment bar 52 connected thereto are caused to move in the direction of the processing line with respect to the transfer bar 44. As a result, one pair of cross bars 60 are moved toward or away from each other through the pinion 54, the horizontal rack 55, the vertical rods 58 and 59 and the supporting stands 56 and 57.

The above-described motions are so combined that the works 62 are sequentially transferred toward the downstream direction of the processing line and pressed at each press station.

The vertical stroke and the horizontal stroke of the motion of the cross bars 60 and the timing of the vertical and horizontal motion thereof can be arbitrarily selected by changing the cam profiles of the lift cam 71 and the distance adjustment cam 72, which selection is not adversely affected by the stroke of the trolley 42 which in turn is dependent upon the transfer lever 64. In the case where no relative movement of a pair of cross bars toward or away from each other is needed owing to specific shapes and materials of the works 62, the cam profile of the distance adjustment cam 72 may be shaped to maintain an angle between the distance adjustment lever 69 and the transfer lever 64 always at a predetermined value during the swinging motion.

The transfer driving system of the first embodiment described above is simple in construction and can freely determine the vertical and horizontal strokes of a pair of cross bars 60 and the timing of the vertical and horizontal motions thereof. And the available strokes are longer in length. Furthermore, the component parts are connected with pin joints so that any play between the connected parts can be reduced to a minimum and therefore the press operation can be carried out with a high degree of dimensional accuracy.

Moreover, the transfer device is so designed and constructed that the trolleys 42 reciprocate along the guides 40 and 41 which are vertically locked during the transfer of works 62; during the transfer, only work supporting means comprising the guide plate 51, the supporting stands 56 and 57 and the pair of cross bars 60 supported on the trolley 42 is permitted to vertically move. As a result, the lift mechanism is made compact in size and light in weight and only small power is needed to vertically move the cross bars 60. No vibrations or oscillations occur during the operation of the lift mechanism so that the vacuum cups 60 positively suck the works 62 and do not release or drop them due to vibrations and oscillations during the operation. Thus, it becomes possible to increase the speed of the processing line, thereby improving productivity.

Figure 10:
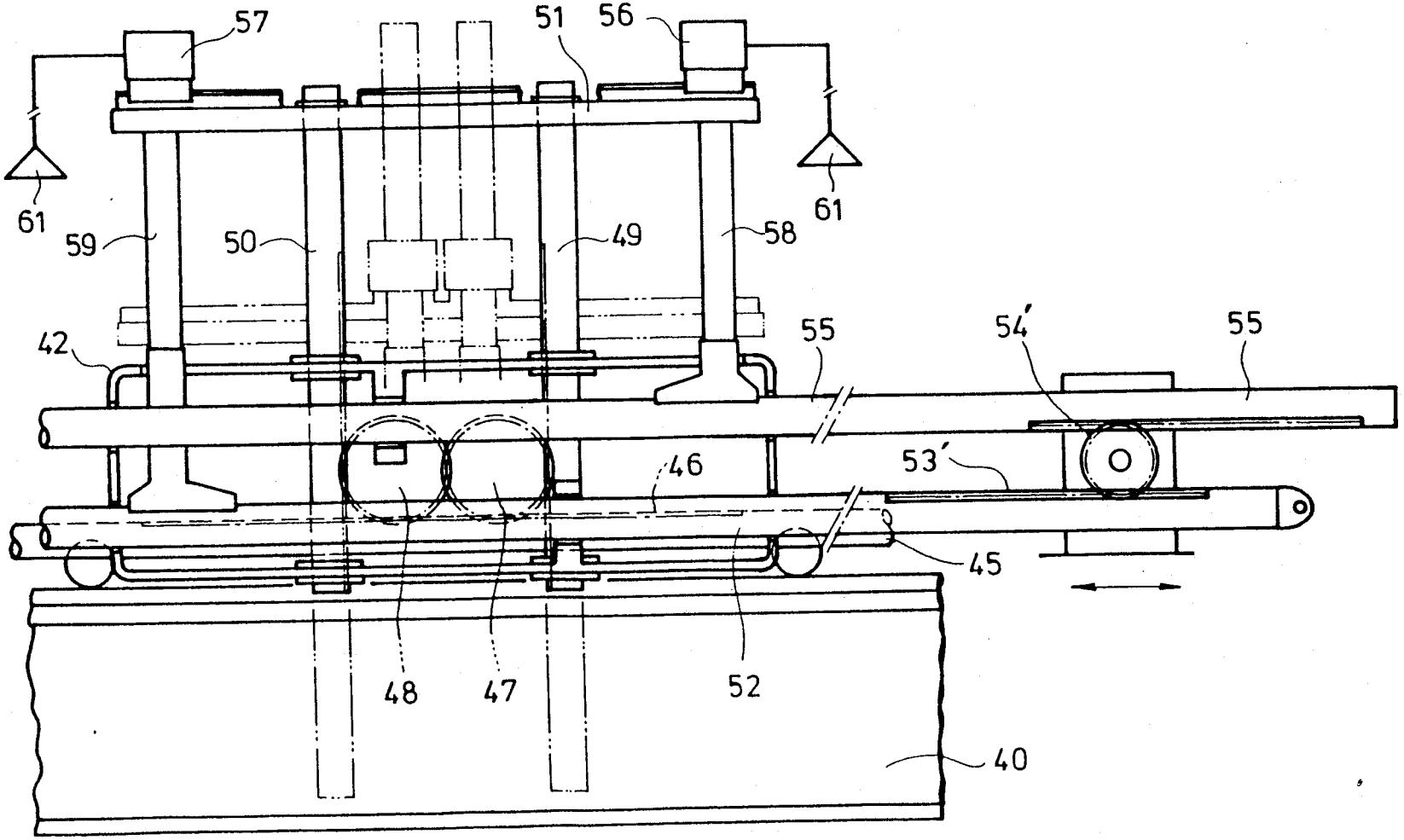
FIG. 10 is a side view of a first modification of the first embodiment of the present invention.
Figure 11:
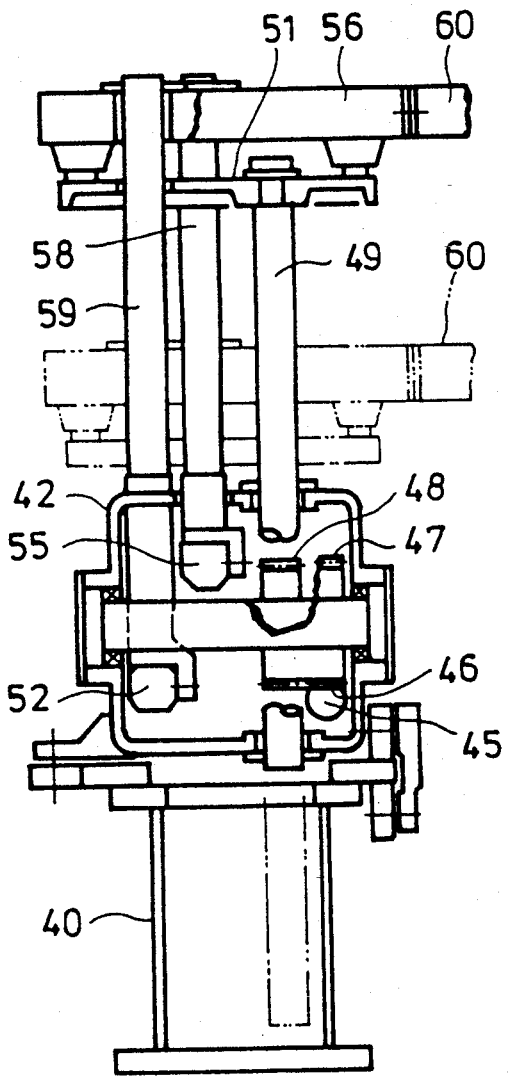
FIG. 11 is a front view thereof.

FIGS. 10 and 11 show a first modification of the first embodiment of the present invention in which a rack 53' of the distance adjustment bar 52 and a rack portion of the horizontal rack 55 are formed outside of the trolley 42 and a pinion 54' is made in mesh with these racks such that it is moved in the direction of the processing line in unison with the trolley 42. Therefore the trolley 42 can be further made light in weight so that in addition to the effects attained by the first embodiment described above, the speed of the processing line can be further increased.

Figure 12:
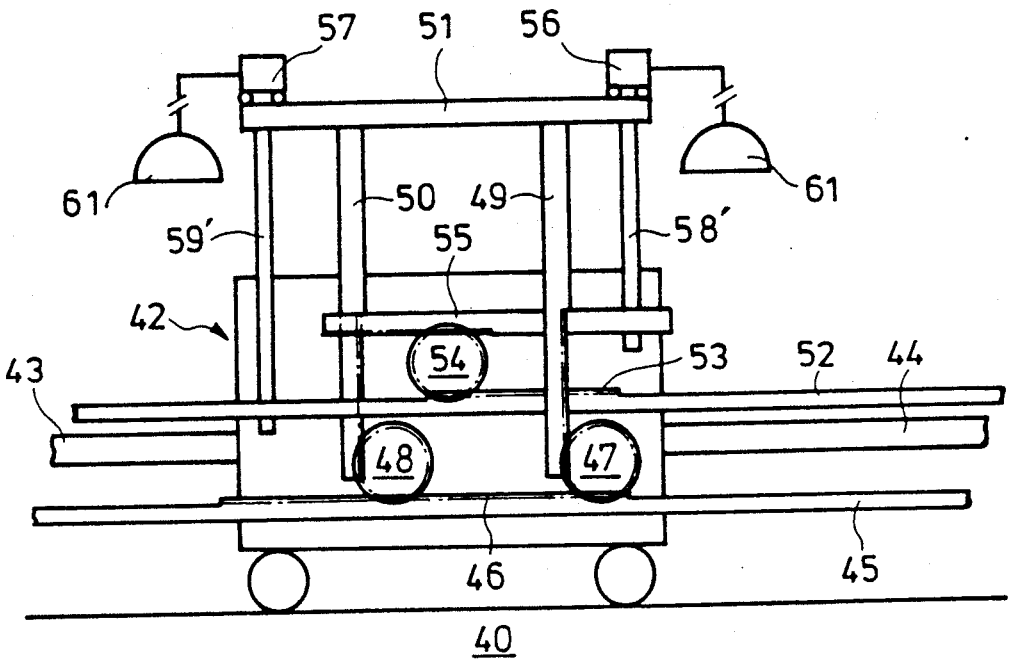
FIG. 12 is a side view of a second modification of the first embodiment of the present invention.

FIG. 12 shows a second modification of the first embodiment in which the horizontal rack 55 and the distance adjustment bar 52 freely extend through and are supported by the lower end portions of the vertical rods 58' and 59'. The second modification can also attain the same effects and features as the first embodiment.

Figure 13:
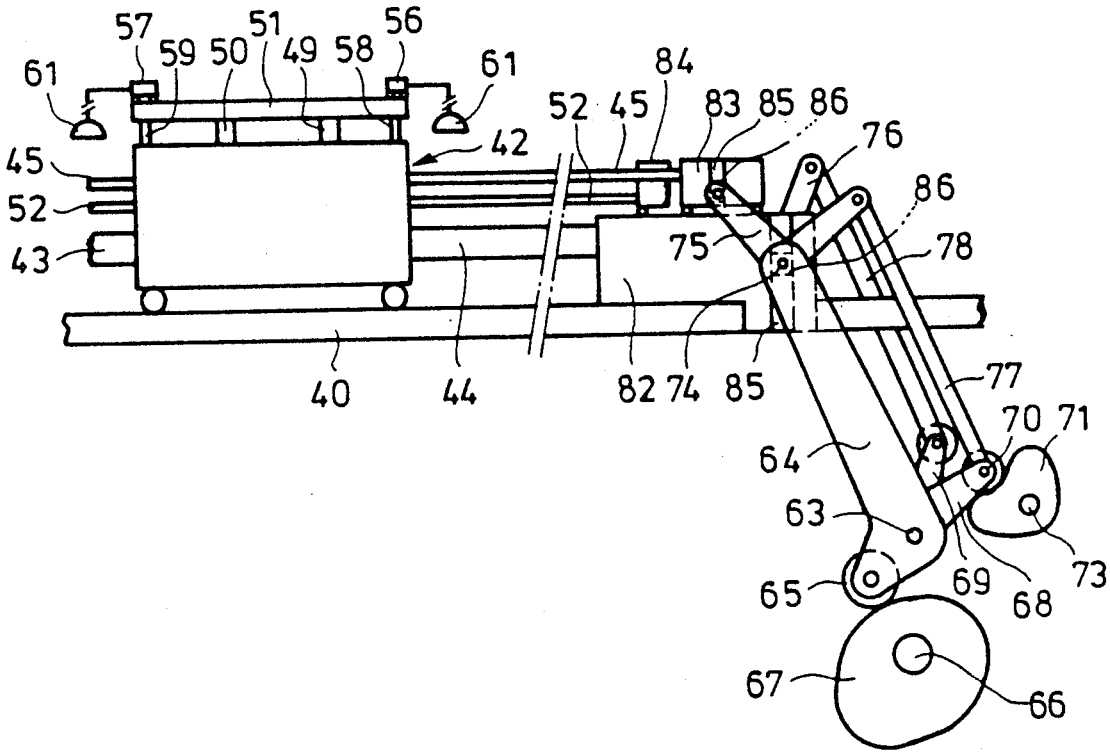
FIG. 13 is a side view of a third modification of the first embodiment of the present invention.

FIG. 13 shows a third modification of the first embodiment of the present invention in which the transfer lever 64 and the transfer bar 44 are interconnected through a carriage 82 movable in the direction of the processing line along the guide 40; the lift rocker 75 and the lift bar 45 are interconnected through a carriage 83 movable on the carriage 82 in the direction of the processing line; and the distance adjustment rocker 76 and the distance adjustment bar 52 are interconnected through a carriage 84 movable on the carriage 82 in the direction of the processing line. The third modification can also attain the same effects and features as the first embodiment.

Figure 14:
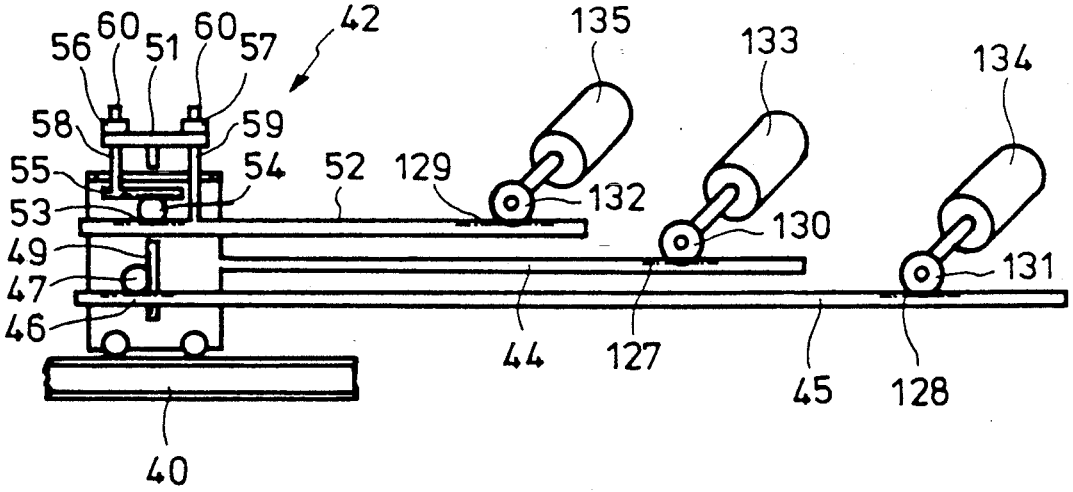
FIG. 14 is a side view of a fourth modification of the first embodiment of the present invention.

FIG. 14 shows a fourth modification of the first embodiment of the present invention in which the transfer bar 44, the lift bar 45 and the distance adjustment bar 52 are formed with racks 127, 128 and 129, respectively, which in turn are in mesh with pinions 130, 131 and 132, respectively, carried by the driving shafts, respectively, of motors 133, 134 and 135 such as servomotors, the transfer bar 44, the lift bar 45 and the distance adjustment bar 52 are reciprocated in the direction of the processing line. The fourth modification can also attain the same effects and features as the first embodiment.

Second Embodiment

Figure 15:
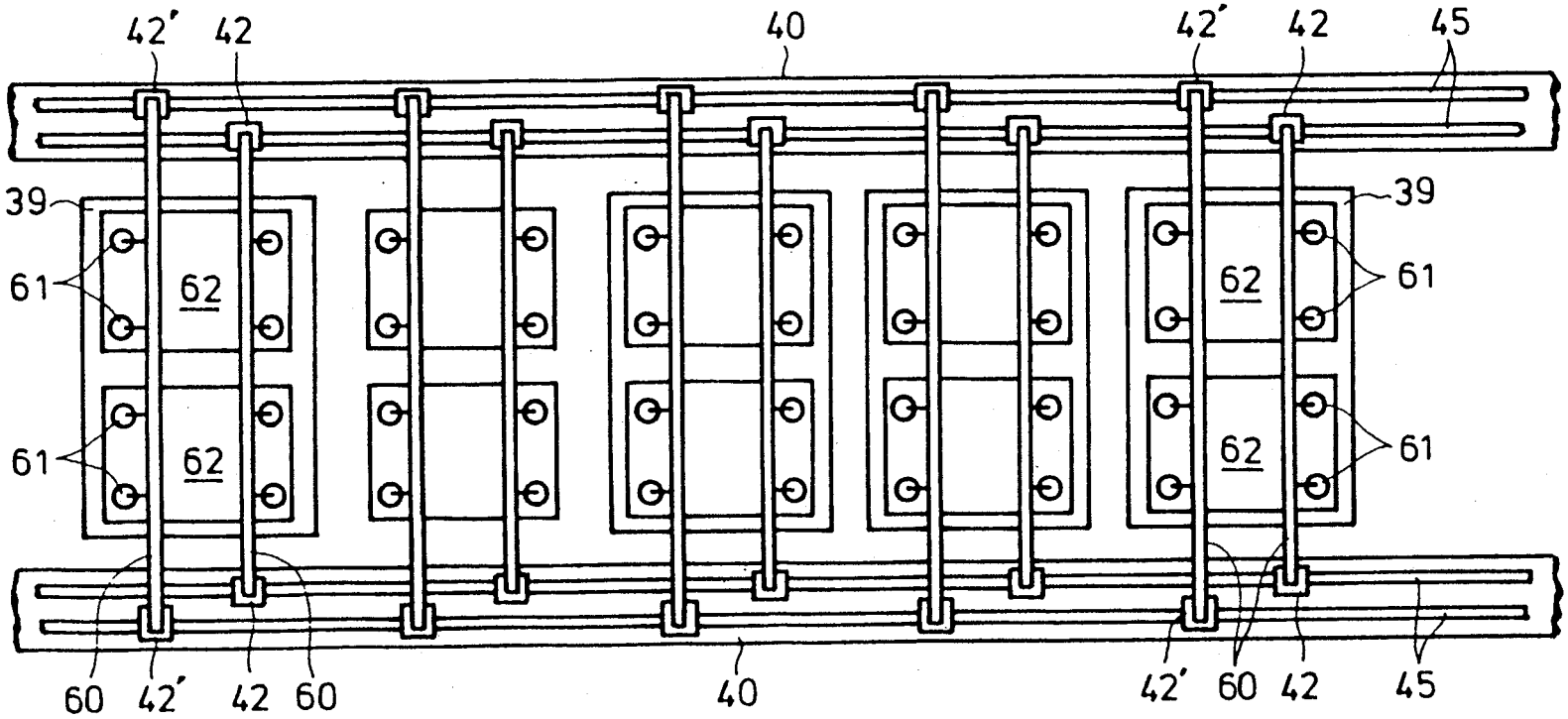
FIG. 15 is a top view of a second preferred embodiment of a transfer device in accordance with the present invention.
Figure 16:
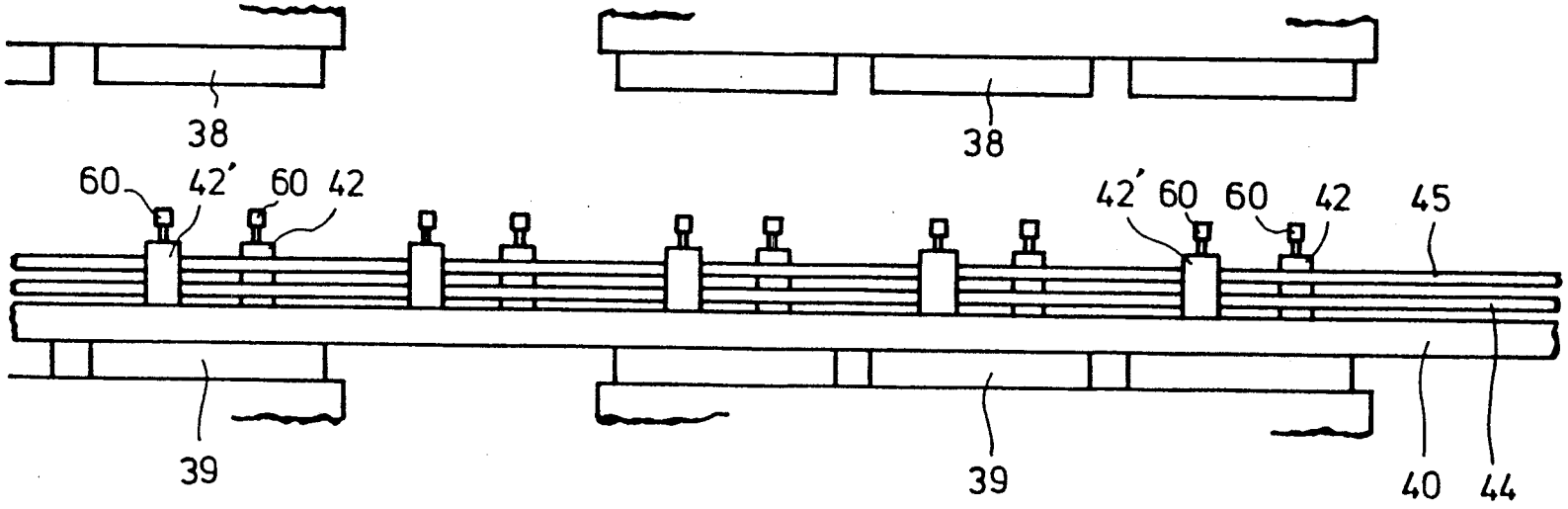
FIG. 16 is a side view thereof.
Figure 17:
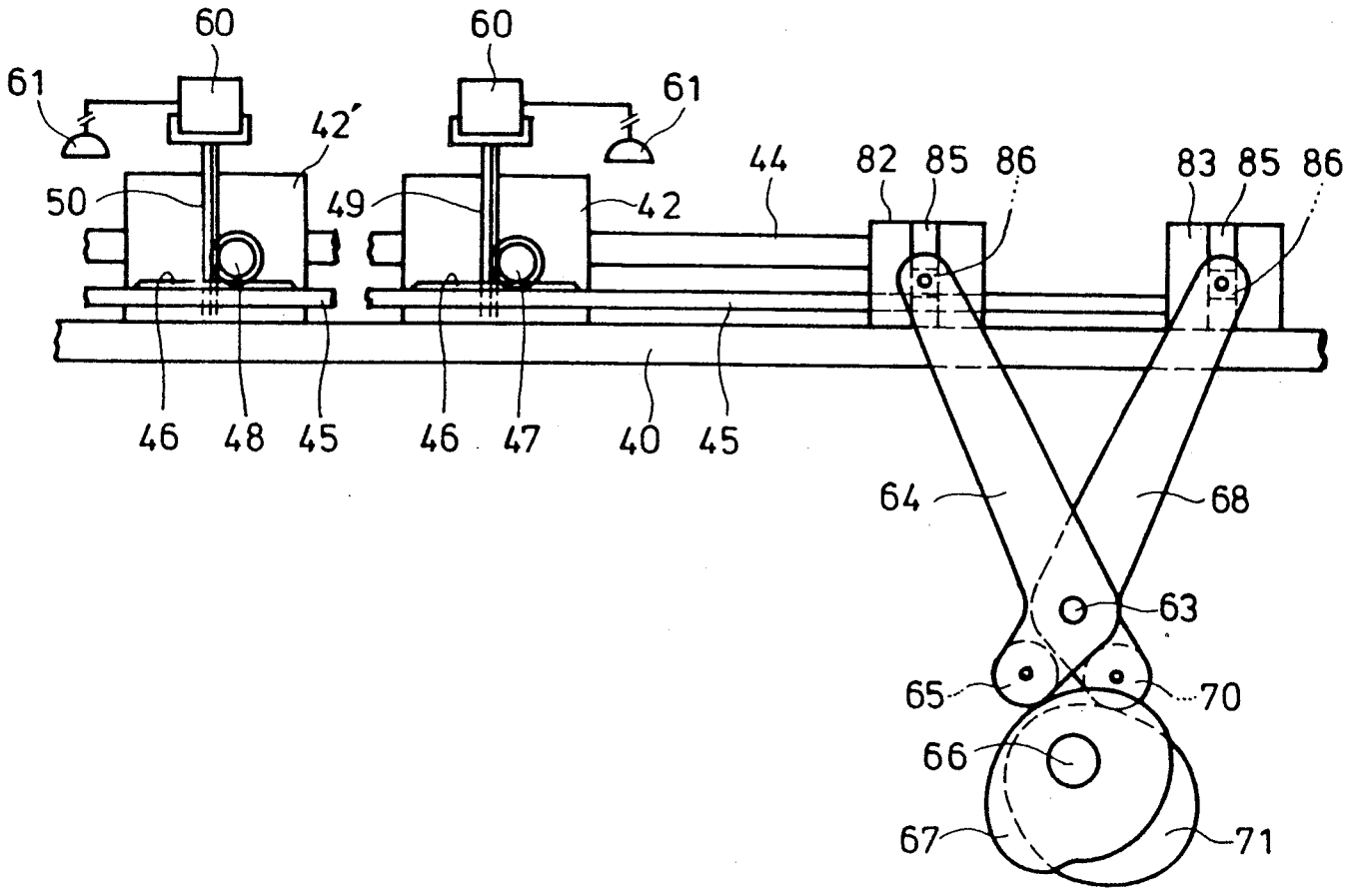
FIG. 17 is a side view of a transfer driving device used in the second embodiment shown in FIG. 15.
Figure 18:
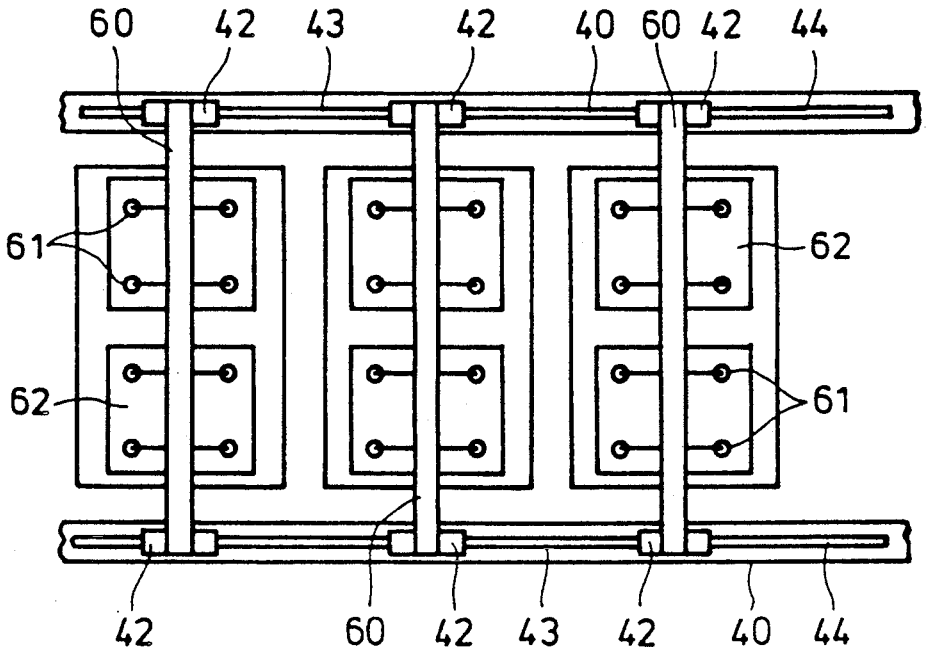
FIG. 18 is a top view of a third preferred embodiment of a transfer device in accordance with the present invention.
Figure 19:
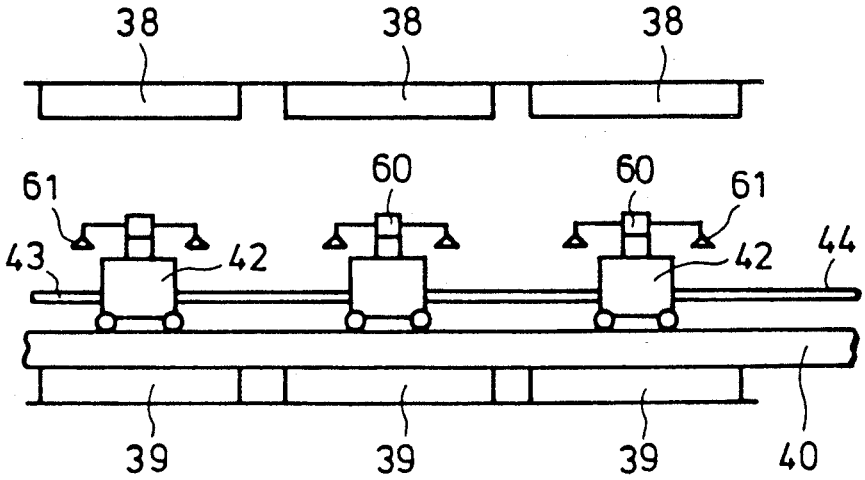
FIG. 19 is a side view thereof.
Figure 20:
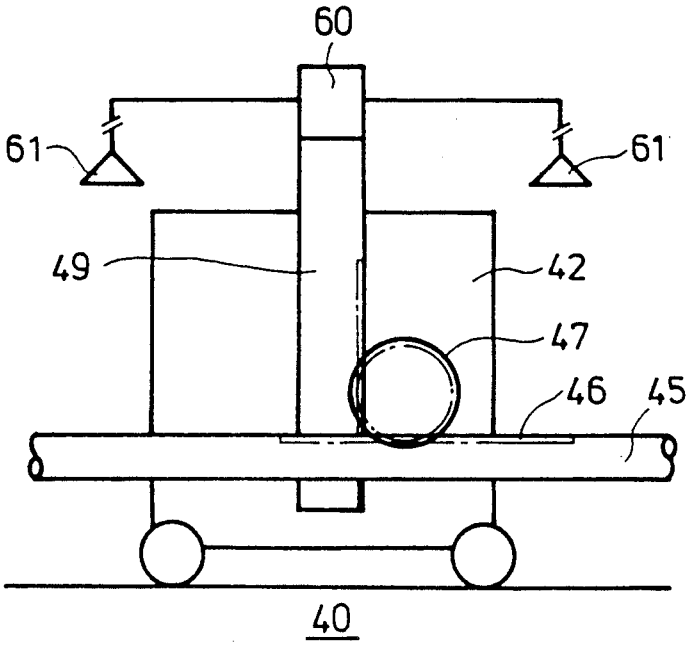
FIG. 20 is a side view on enlarged scale of a trolley used in the third embodiment of the present invention shown in FIG. 18.
Figure 21:
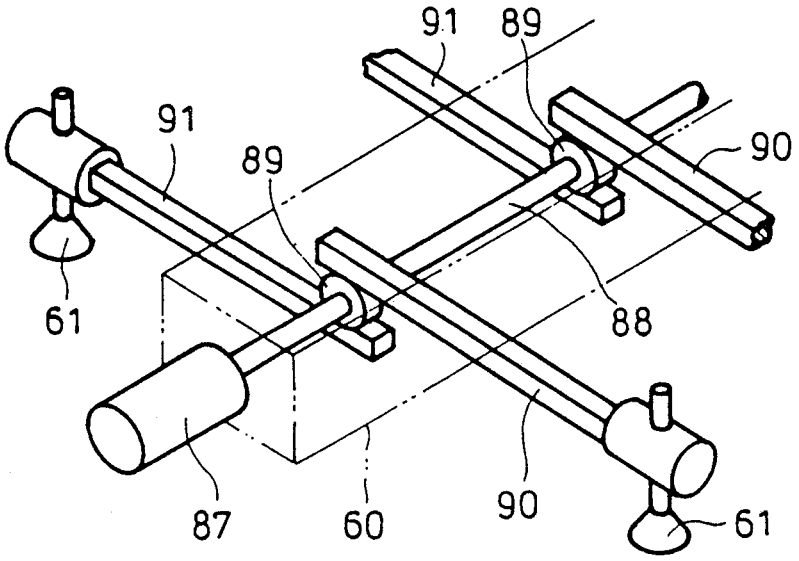
FIG. 21 is a perspective view, on enlarged scale, of a cross bar of the trolley shown in FIG. 18.

Referring now to FIGS. 15–17, a second preferred embodiment of the present invention will be described which is substantially similar in construction to the first embodiment except that a pair of cross bars 60 are supported by two pairs of transversely opposing trolleys 42 and 42', respectively, such that the cross bars 60 can be vertically moved independently of each other. The trolleys 42 and 42' are drivingly coupled to two transfer driving systems each including the transfer lever 64, the lift lever 68 and so on. In FIG. 17, the driving system for moving the trolley 42' is not shown. It is of course apparent that the driving systems shown in FIGS. 8, 13 and 14 may be designed and constructed to include only a transfer mechanism and a lift mechanism as needs demand, which fact is also applied to preferred embodiments and their modifications to be described below.

In the second embodiment, the transfer levers 64 in the two driving systems are driven independently of each other to effect the work transfer operation and the movement toward or away from each other of one set of trolleys 42 and 42' and hence a pair of cross bars 60.

Like the first embodiment, according to the second embodiment, the lift mechanism can be made compact in size and light in weight so that the driving force can be reduced. Furthermore, the works can be prevented from dropping during the transfer step so that the speed of the processing line can be increased, improving productivity. In addition, the lift mechanism incorporated in each trolley is lighter in weight as compared with the first embodiment, the speed of the processing line can be further increased.

Third Embodiment

Referring now to FIGS. 18–21, a third embodiment of the present invention will be described which is substantially similar in construction to the first embodiment except the following arrangements. Only one cross bar 60 is vertically movably supported by the pair of opposing trolleys 42. A shaft 88 extends through the cross bar 60 in the longitudinal axis thereof and is driven by a motor 87. A plurality of pinions 89 are mounted on the shaft 88 and spaced apart from each other. The pinions 89 are made in mesh with a pair of upper and lower racks 90 and 91 extending in the direction of the processing line and vacuum cups 61 are attached to one end of the racks 90 and 91 remote from the pinion 89. When a motor 87 such as a servomotor is energized, the upper and lower racks 90 and 91 are moved in opposite directions through the shaft 88 and the pinion 89 so that the cross bar 60 is moved toward or away from the adjacent upstream and downstream side cross bars 60.

According to the third embodiment, like the second embodiment described above, the lift mechanism can be made compact in size and light in weight so that the driving force can be reduced and the works 62 can be prevented from being released and dropping from the vacuum cups 61. As the result, the speed of the processing line can be increased so that productivity can be improved. In addition, the trolley 42 can be made light in weight so that the speed of the processing line can be further increased.

In a case where no distance adjustment movement is required depending upon kind or variety of the works 62, the vacuum cups 61 may be directly attached to the cross bar 60.

Figure 22:
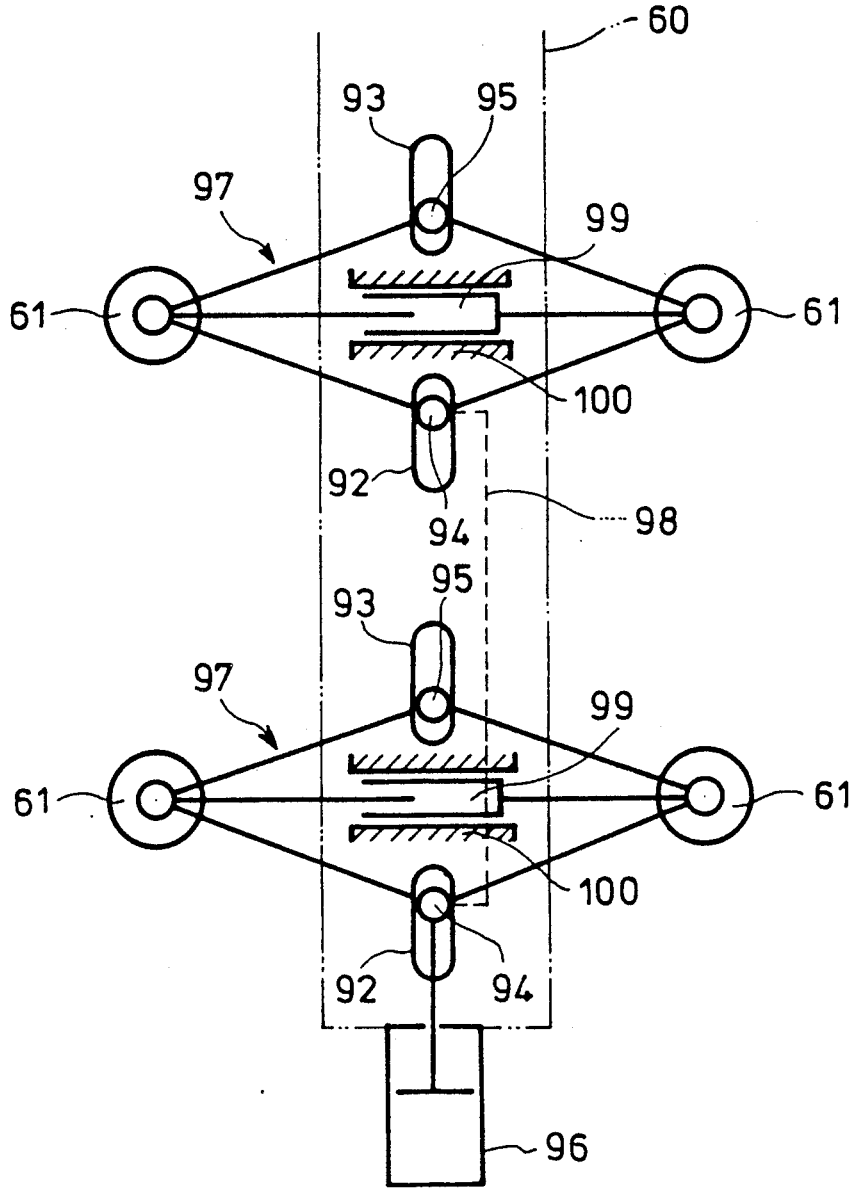
FIG. 22 is a top view of a modification of the third preferred embodiment of the present invention.
Figure 23:
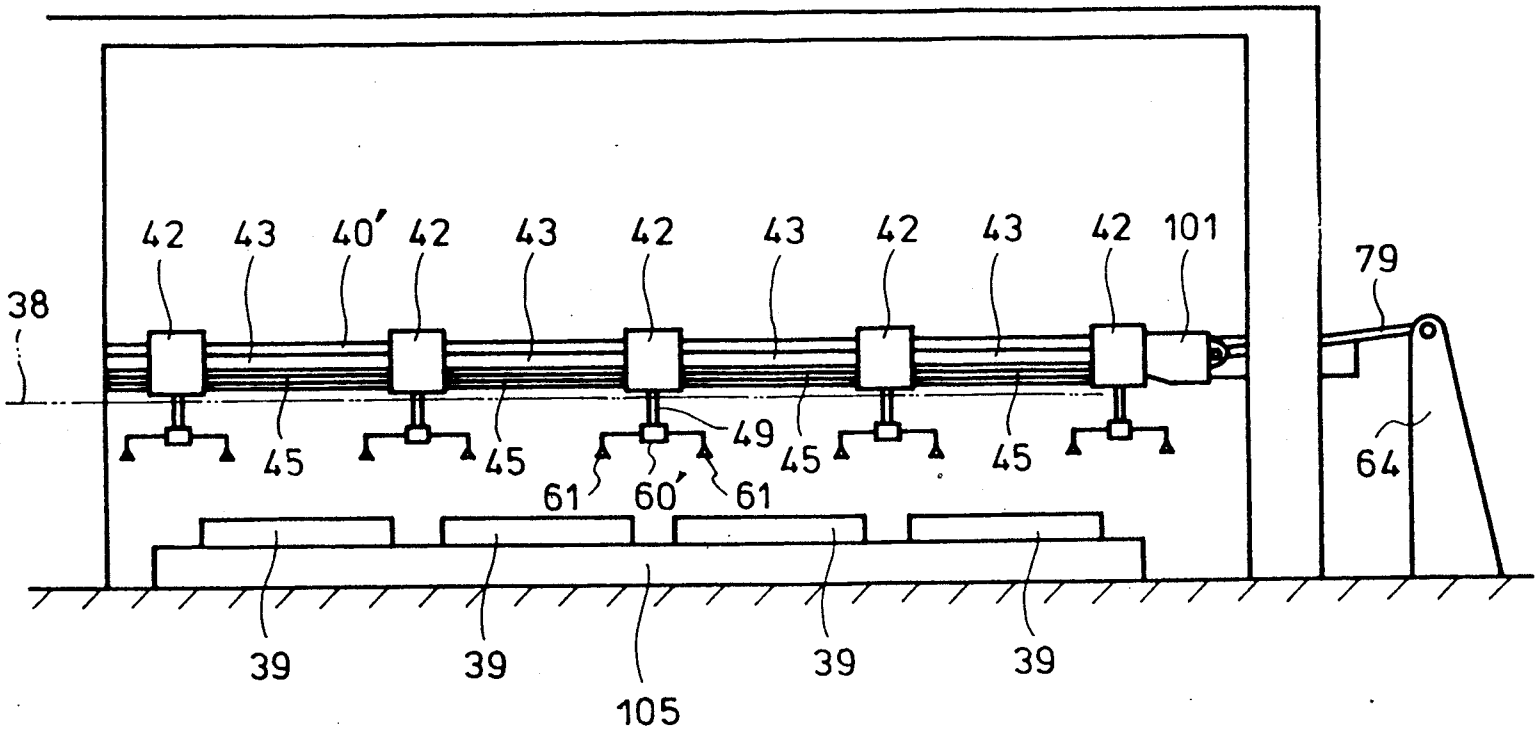
FIG. 23 is a side view of a fourth preferred embodiment of a transfer device in accordance with the present invention.
Figure 24:
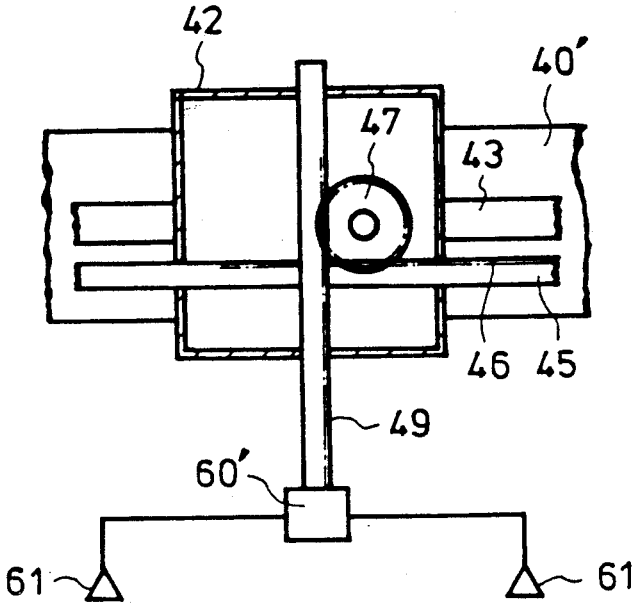
FIG. 24 is an enlarged view of a trolley used in the fourth embodiment shown in FIG. 23.
Figure 25:
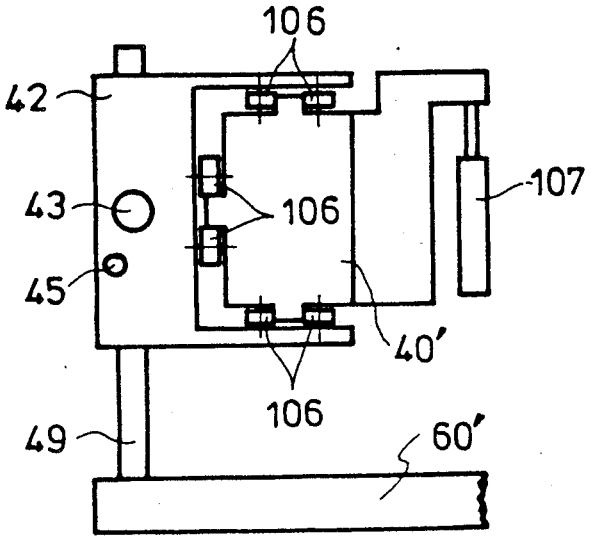
FIG. 25 is a front view thereof.
Figure 26:
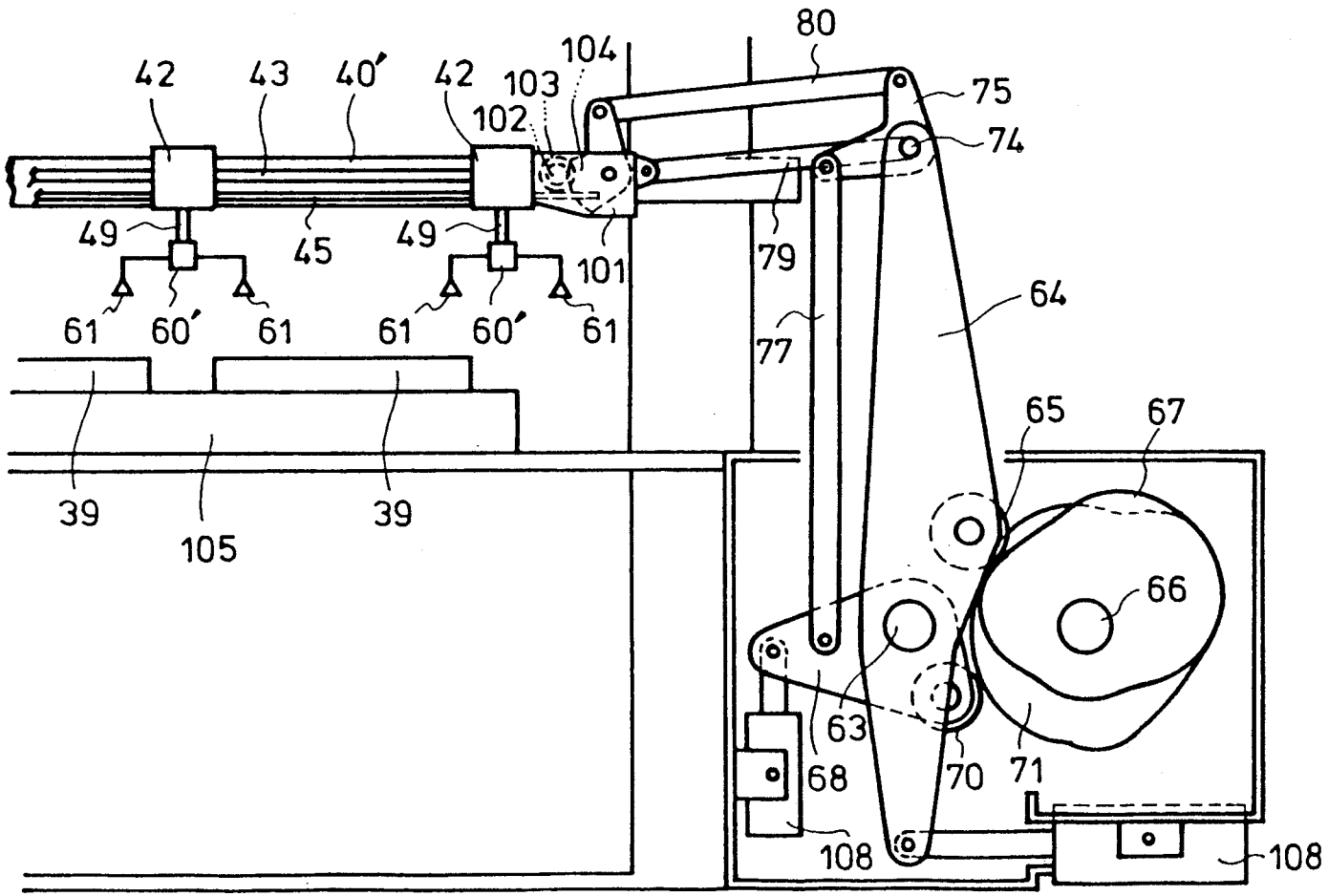
FIG. 26 is a view used to explain a transfer driving device used in the fourth preferred embodiment shown in FIG. 23.

FIG. 22 shows a modification of the third embodiment of the present invention in which a pair of elongated slots 93 extend in the longitudinal direction of the cross bar 60 and are formed through the cross bar 60 in spaced-apart relationship. Pins 94 and 95 are slidably fitted into the elongated slots 92 and 93, respectively, and one pin 94 is connected to the piston rod of a cylinder 96 which is extendable and retractable in the longitudinal direction of the cross bar 60. Adjacent two links of a pantograph 97 are joined to the pin 93 while the remaining two links of the pantograph are joined to the pin 94. That is, two opposing apexes of the pantograph or parallelogram 97 are connected to the pins 93 and 94. The remaining two opposing apexes of the pantograph 97 are joined to the vacuum cups 61. Therefore when a cylinder 96 is extended or retracted, the pins 94 and 95 are displaced in the elongated slots 92 and 93, respectively, so that the pantograph 97 is driven to move the vacuum cups 61 toward or away from each other. The modification of the third embodiment with the above described construction can also attain the same effects and features of the third embodiment.

In FIG. 22, reference numeral 98 represents a link interconnecting between the pins 94; 99, an expandable-and-retractable diagonal member interconnecting the vacuum cups 61; and 100, a guide formed through the cross bar 60 for guiding the diagonal member 99.

Fourth Embodiment

FIGS. 23–26 show a fourth embodiment of the present invention which is substantially similar in construction to the third embodiment described above except that the guide 40' is disposed in substantially in coplanar relationship with or at a position higher than the upper surface of the upper die 38 when the die 38 is removed and placed over the lower die 39 during the replacement of the upper and lower dies 38 and 39 in a press (not shown) (In FIG. 23, the guide 40' is shown as being disposed at a position higher than the upper end of the stroke of the upper die 38.); and a cross bar 60' is securely attached to the lower end of the vertical rack 49.

A gear box 101 mounted on the most downstream trolley 42 is connected to a rod 79 extending from the upper end portion of the transfer bar 64. A rod 80 extends from the upper end portion of the lift link 75 and is connected to a sector gear 104 which transmits the driving force to the lift bar 45 through gears 102 and 103 mounted in the gear box 101.

Reference numeral 105 designates a bolster upon which the lower die 39 is mounted in replacement of the upper and lower dies 38 and 39; 106, rollers attached to the trolley 42; 107, a cylinder for adjusting the height of the guide 40; and 108, a clamping cylinder.

Instead of the vacuum cups 61 directly attached to the cross bar 60', the vacuum cups 61 may be indirectly mounted on the cross bar 60' for distance adjustment movement as is the case with the third embodiment.

Like the third embodiment, according to the fourth embodiment of the present invention, the lift mechanism can be made compact in size and light in weight so that the driving power can be reduced and the works can be prevented from being released and dropped from the vacuum cups 61. As a result, the speed of the processing line can be increased so that productivity can be improved.

Furthermore, according to the fourth embodiment, the guide 40' is disposed at a high position so that in maintenance or replacement operation of the upper and lower dies 38 and 39, it is not needed to lift and retract the guide 40' so that the replacement or maintenance of the dies 38 and 39 can be accomplished in a relatively short time period, whereby productivity can be further improved.

Figure 27:
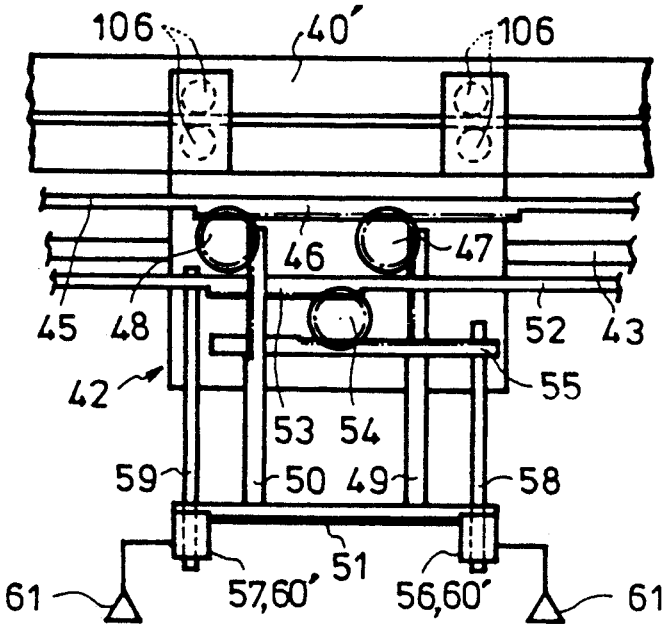
FIG. 27 is a side view of a first modification of the fourth preferred embodiment of the present invention.
Figure 28:
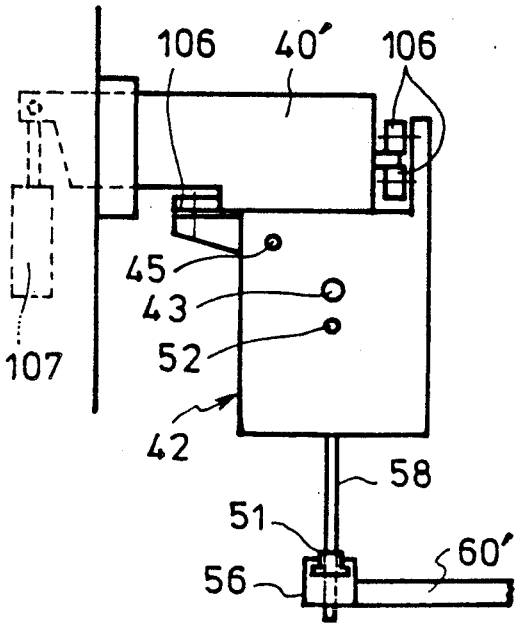
FIG. 28 is a front view thereof.

FIGS. 27 and 28 show a first modification of the fourth embodiment of the present invention in which, like the first embodiment, a pair of cross bars 60' are supported between the transversely opposing trolleys 42. The first modification can also attain the same effects and features of the fourth embodiment.

Figure 30:
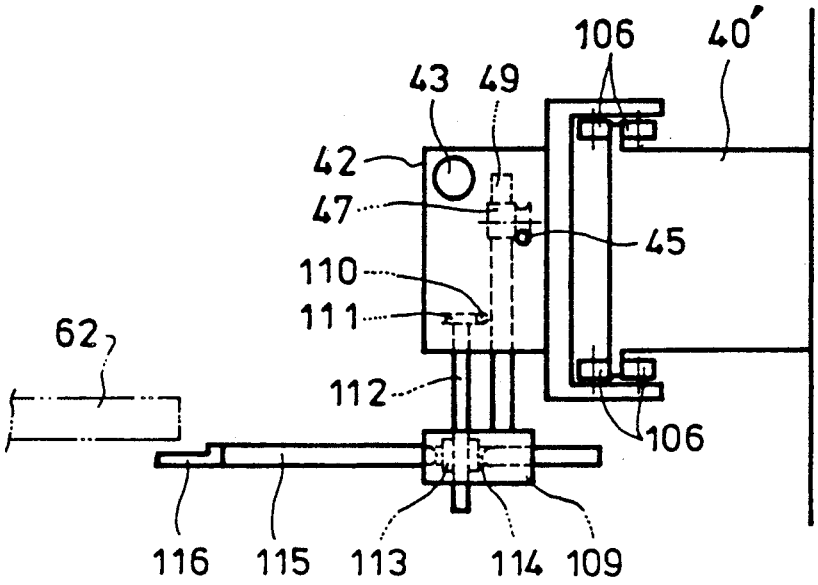
FIG. 30 is a front view of a trolley used in the second modification shown in FIG. 29.
Figure 29:
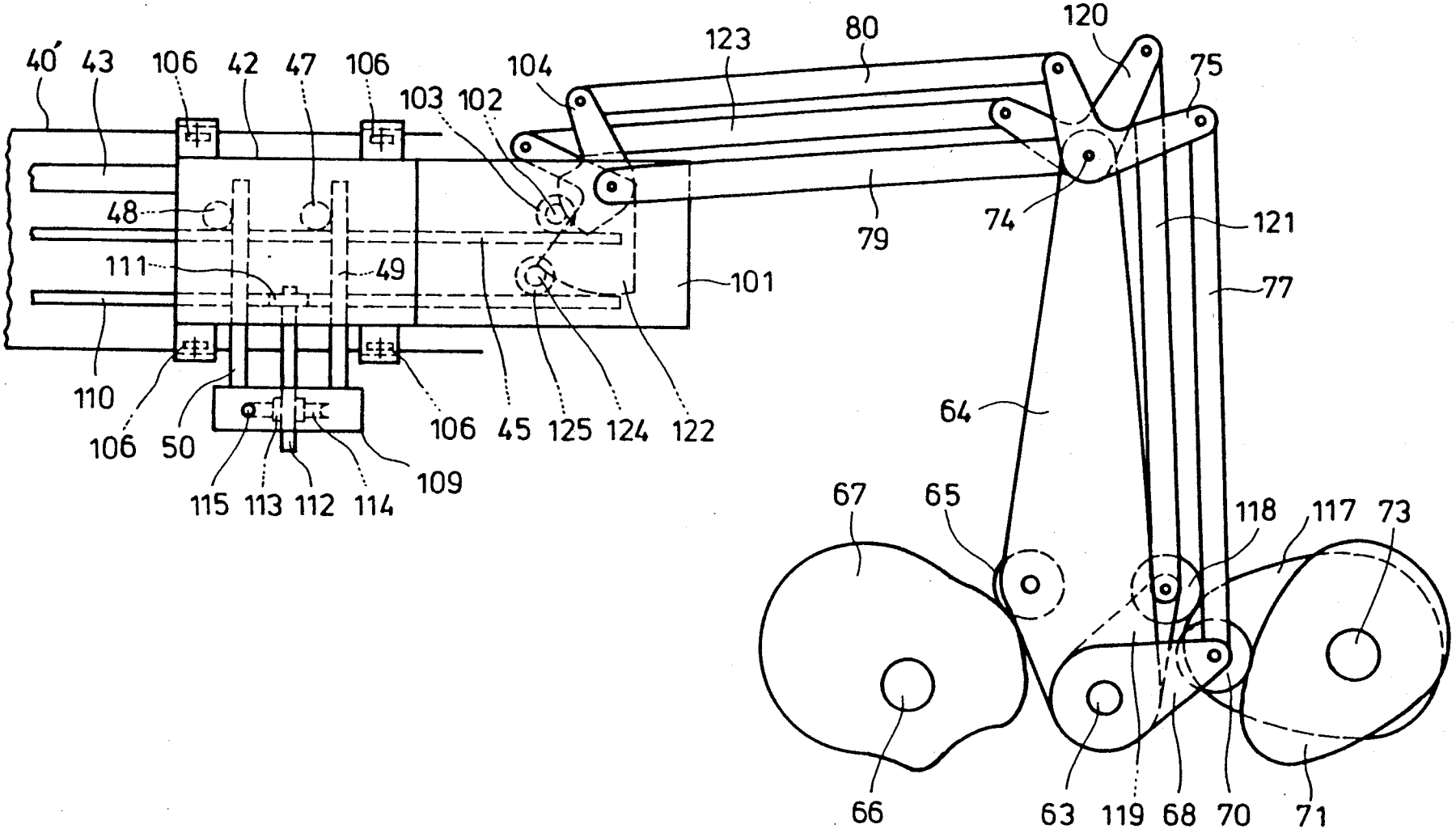
FIG. 29 is a side view of a second modification of the fourth preferred embodiment of the present invention.

FIGS. 29 and 30 show a second modification of the fourth embodiment of the present invention. A supporting member 109 is securely attached to the lower ends of the vertical racks 49 and 50. An opening-and-closing rack 110 which is reciprocable in the direction of the processing line extends through the trolley 42. The upper end of a vertically extending rotating shaft 112 which is rotatably supported through bearings (not shown) in the trolley 42 is securely joined to the center of rotation of a pinion 111 in mesh with the rack 110 and the lower end portion of the shaft 112 extends through the supporting member 109. A linker bearing 113 is fitted over the shaft 112 within the working member 109 such that it can be rotated in unison with the rotating shaft 112 and can slide in the axial direction thereof. A pinion 114 is securely fitted over the outer periphery of the linear bearing 114 and is made into mesh with a rack of a work supporting means 115 such as a finger-like shaft which extends perpendicular to the direction of the processing line and freely extends through the supporting member 109. A work holding means 116 such as a finger is joined to the end of the finger-like shaft 115 close to the die so that when the opening-and-closing rack 110 moved in the direction of the processing line, the finger 116 at the extreme end of the shaft 15 can be opened or closed in the direction perpendicular to the direction of the processing line.

Furthermore, an opening-and-closing lever 119 which is swingably carried by the pivot pin 63 and driven through a cam follower 118 and an opening-and-closing cam 117 which is rotated by a driving means (not shown), an L-shaped opening-and-closing link 120 attached to the upper end of the transfer bar 64 and an opening-and-closing rod 121 whose upper and lower ends are pivoted to one arm of the L-shaped link 120 and the opening-and-closing lever 119, respectively, define a parallelogram linkage. And a rod 123 equal in length to the rod 79 connects the other arm of the L-shaped link 120 with the sector gear 122 mounted in the gear box 101, thereby forming a second parallelogram linkage. Therefore the driving force is transmitted to the opening-and-closing rack 110 through a gear 124 in mesh with the sector gear 122 mounted in the gear box 101 and a gear 125 carried by the shaft of the gear 124 coaxially thereof.

The second modification of the fourth embodiment with the above-described construction can also attain the same effects and features as the fourth embodiment described above.

Figure 32:
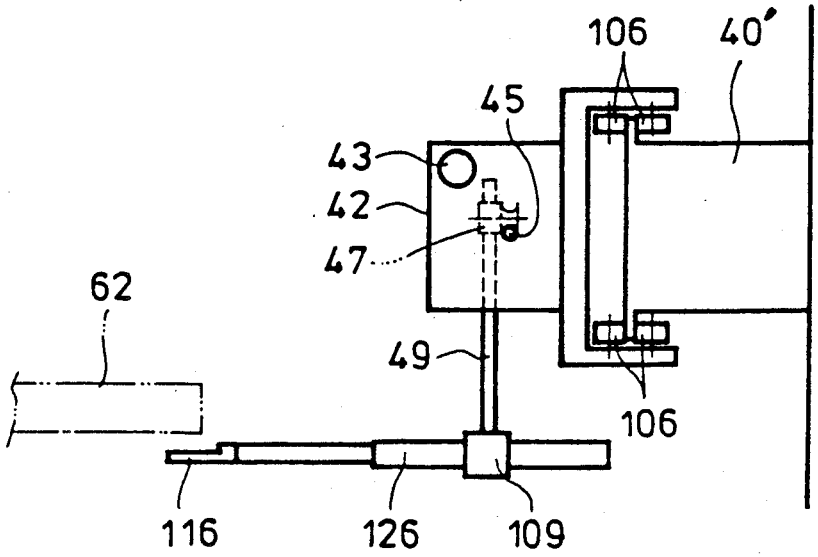
FIG. 32 is a front view of a trolley used in the third modification shown in FIG. 31.
Figure 31:
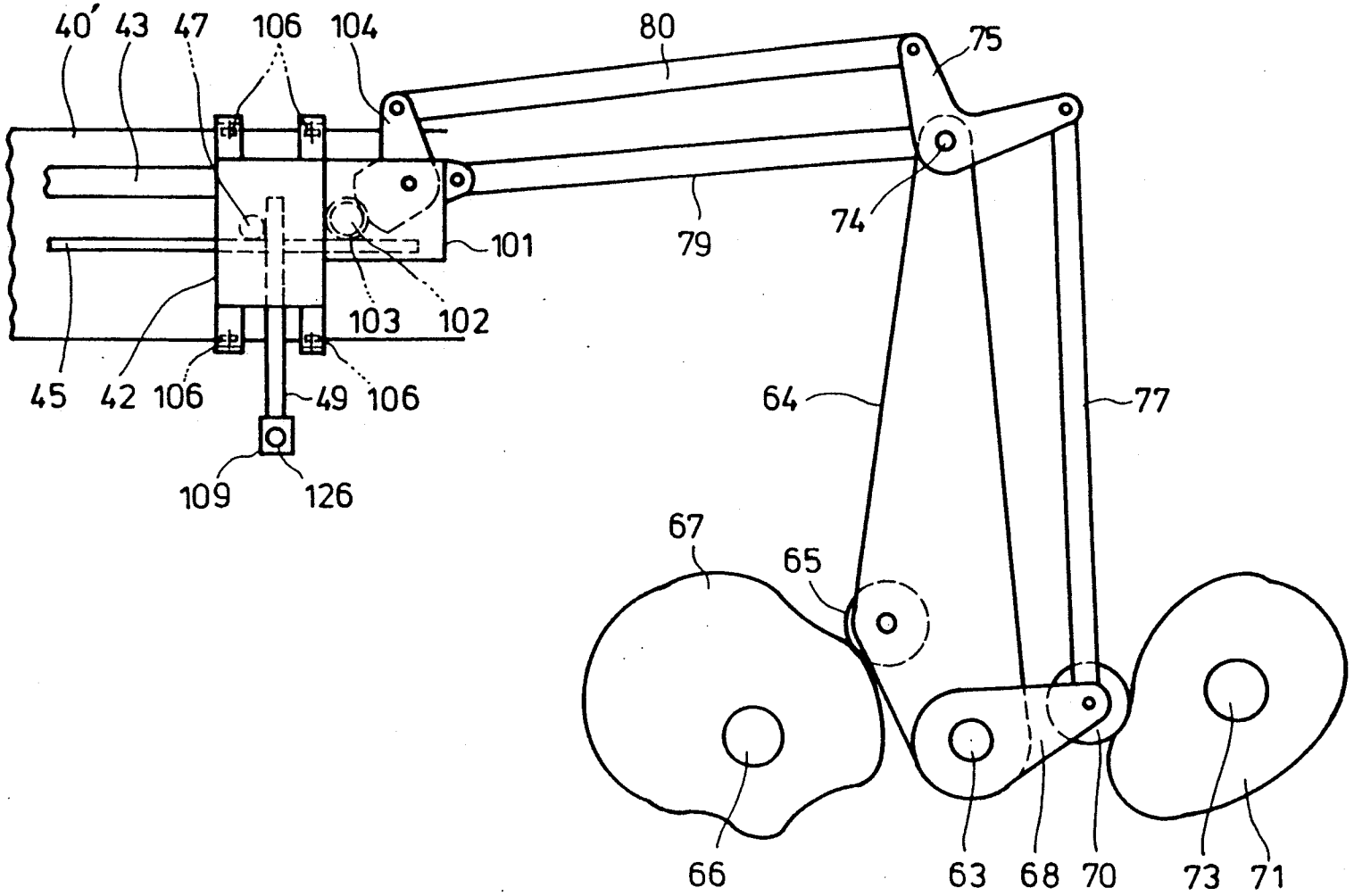
FIG. 31 is a side view of a third modification of the fourth preferred embodiment of the present invention.

FIGS. 31 and 32 show a third modification of the fourth embodiment of the present invention which is substantially similar in construction to the second modification described above with reference to FIGS. 29 and 30 except that the finger 116 is opened or closed by a cylinder 126.

The third modification with the above-described construction can also attain the same effects and features as the fourth embodiment.

Fifth Embodiment

Figure 33:
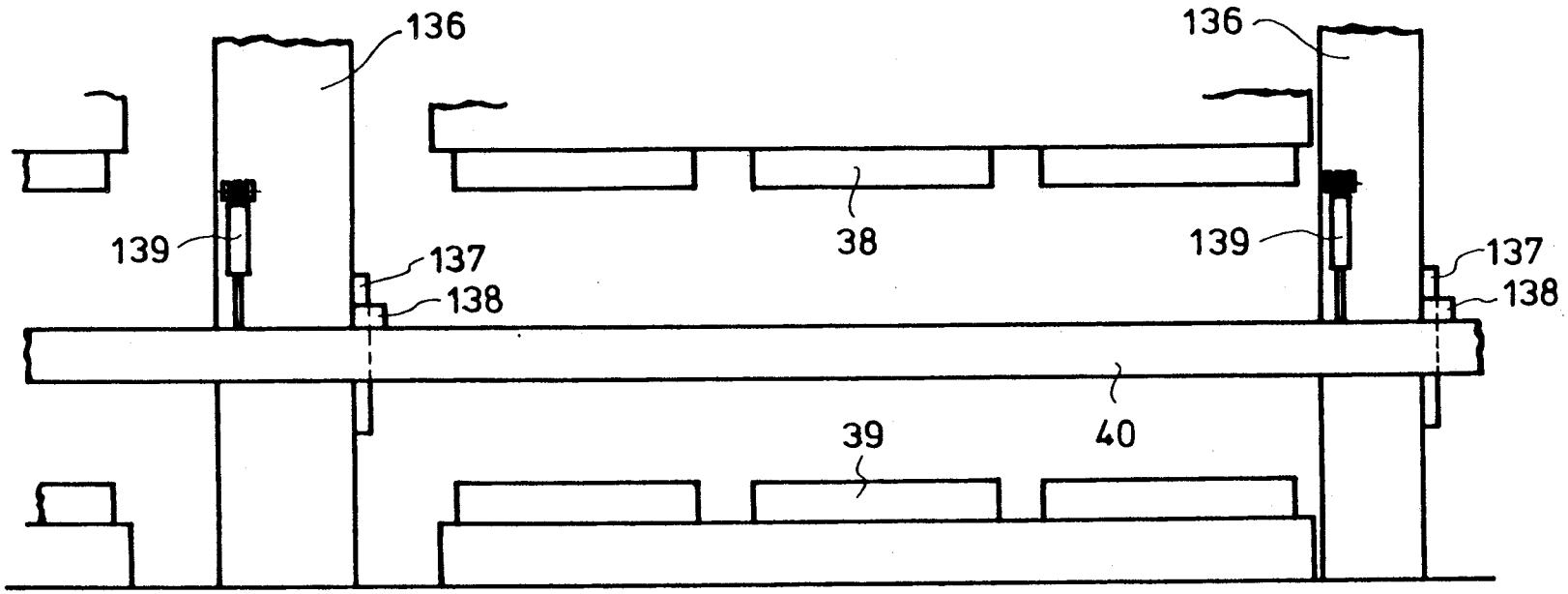
FIG. 33 is a partial side view of a fifth embodiment of the present invention.
Figure 34:
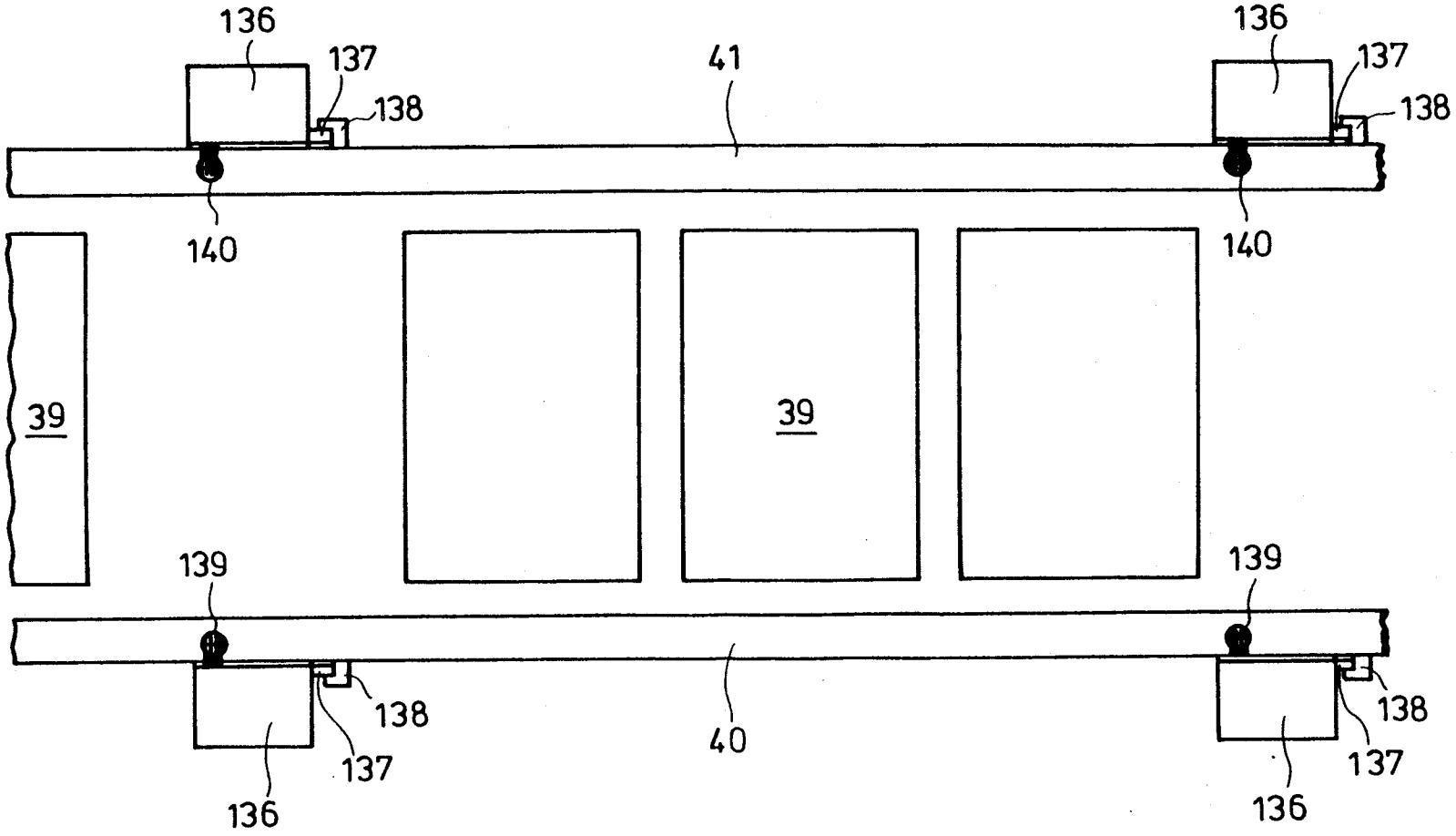
FIG. 34 is a plan view thereof.
Figure 35:
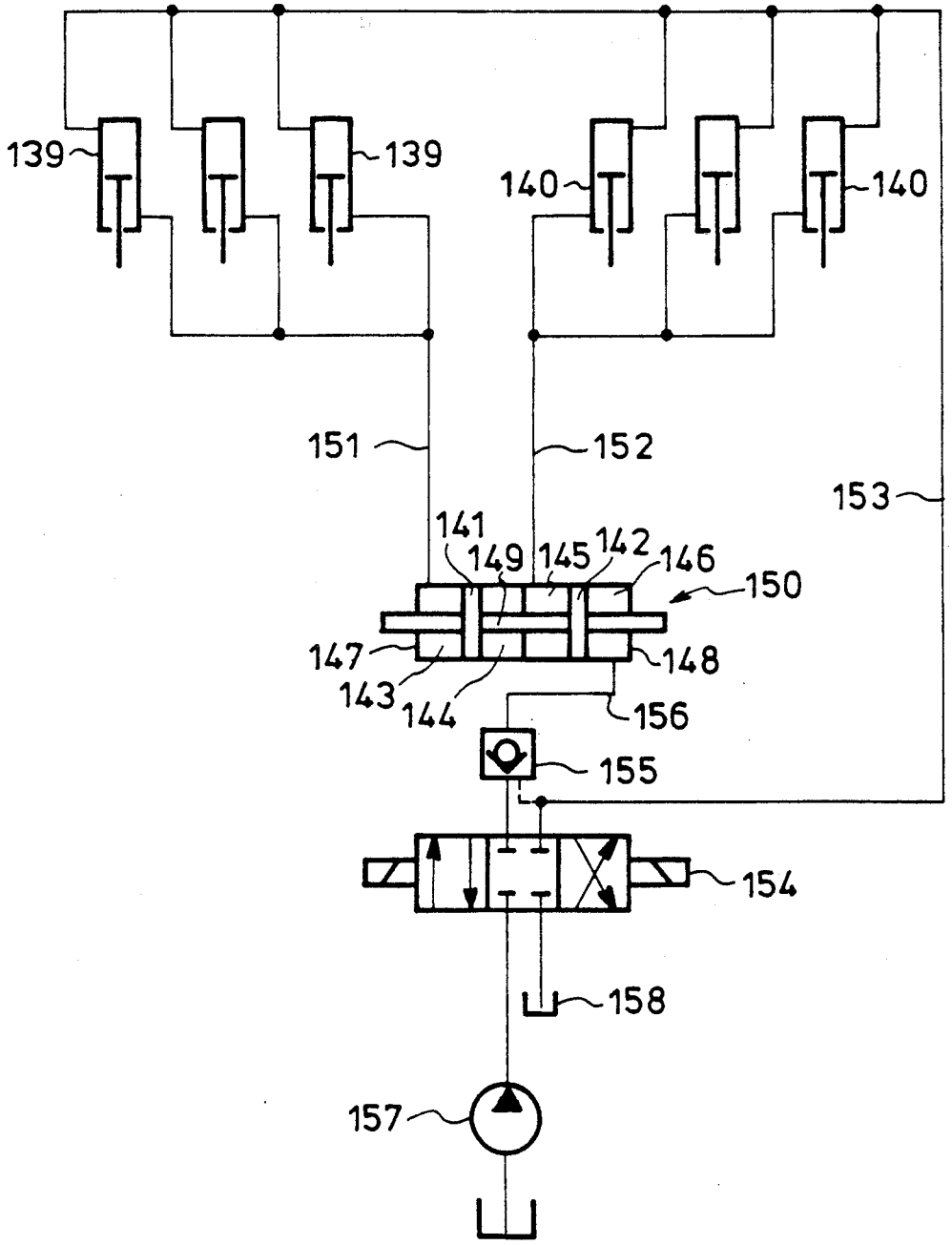
FIG. 35 is a diagram showing a hydraulic circuit used in the fifth embodiment shown in FIG. 33.

FIGS. 33 to 35 show a fifth embodiment of the present invention which is substantially similar in construction to any of the first to fourth embodiments except that uprights 136 for the transfer presses respectively have vertically extending guides members 137 along which guide bodies 138 are slidable. The guide bodies 138 are attached to the pair of guides 40 and 41 and vertically movably support the latter on the uprights 136. The uprights 136 and the guides 40 and 41 are interconnected respectively through cylinders 139 and 140 which serve as height adjusting means. The cylinders 139 and 140 for the guides 40 and 41, respectively, are communicated with a synchronism cylinder 150 which comprises two cylinder portions 147 and 148 as shown in FIG. 35. More specifically, the cylinder portion 147 has a piston 141 and two liquid-pressure chambers 143 and 144 on both sides of the piston 141; in like manner, the cylinder portion 148 has a piston 142 and two liquid-pressure chambers 145 and 146 on both sides of the piston 142. The cylinder portions 147 and 148 are interconnected in series through a rod 149 to thereby provide the synchronism cylinder 150. The liquid-pressure chambers 143 and 145 of the cylinder portions 147 and 148 are communicated through flow passages 151 and 152 with rod-side chambers of the cylinders 139 and 140. Head-side chambers of the cylinders 139 and 140 are communicated through a flow passage 153 with a directional control valve 154 which in turn is communicated with the liquid-pressure chamber 148 of the synchronism cylinder 150 through a flow passage 156 which in turn has a pilot check valve 155 and is communicated at its pilot port with the flow passage 153. The directional control valve 154 is further communicated with a pump 158 as well as a tank 157.

The trolleys and the work supporting means are omitted in FIGS. 33 and 34 for briefness.

The fifth embodiment can of course attain the same effects and features as any of the first to fifth embodiments. Moreover, according to this embodiment, upon the pressing operation the height of the guides 40 and 41 can be adjusted in accordance with the height of the dies 38 and 39 and/or the height of the works to be transferred by means expanding or contracting the cylinders 139 and 140. Upon exchange of the dies 38 and 39 or upon maintenance operation of the transfer presses, the guides 40 and 41 can be retracted to noninterferring positions. More specifically, the guides 40 and 41 may be lifted by feeding working liquid from the tank 175 through the directional control valve 154, the synchronism cylinders 150 to the rodside chambers of the cylinders 139 and 140 to contract the cylinders 139 and 140; on the other hand, the guides 40 and 41 may be lowered by feeding the working liquid to the headside chambers of the cylinders 139 to expand the latter.

The chambers 143 and 145 of the synchronism cylinder 150 are adapted to equally change in volume so that the pair of guides 40 and 41 can be synchronously height-adjusted.

The pilot check valve 155 in the flow passage 156 serves to prevent the back flow from the synchronism cylinder 150 so that the guides 40 and 41 can be maintained in height. When the guides 40 and 41 are to be lowered, the working liquid in the flow passage 153 acts on the pilot port of the pilot check valve 155 to open the latter so that the working liquid can be discharged from the flow passage 156 to the tank 158.

Figure 36:
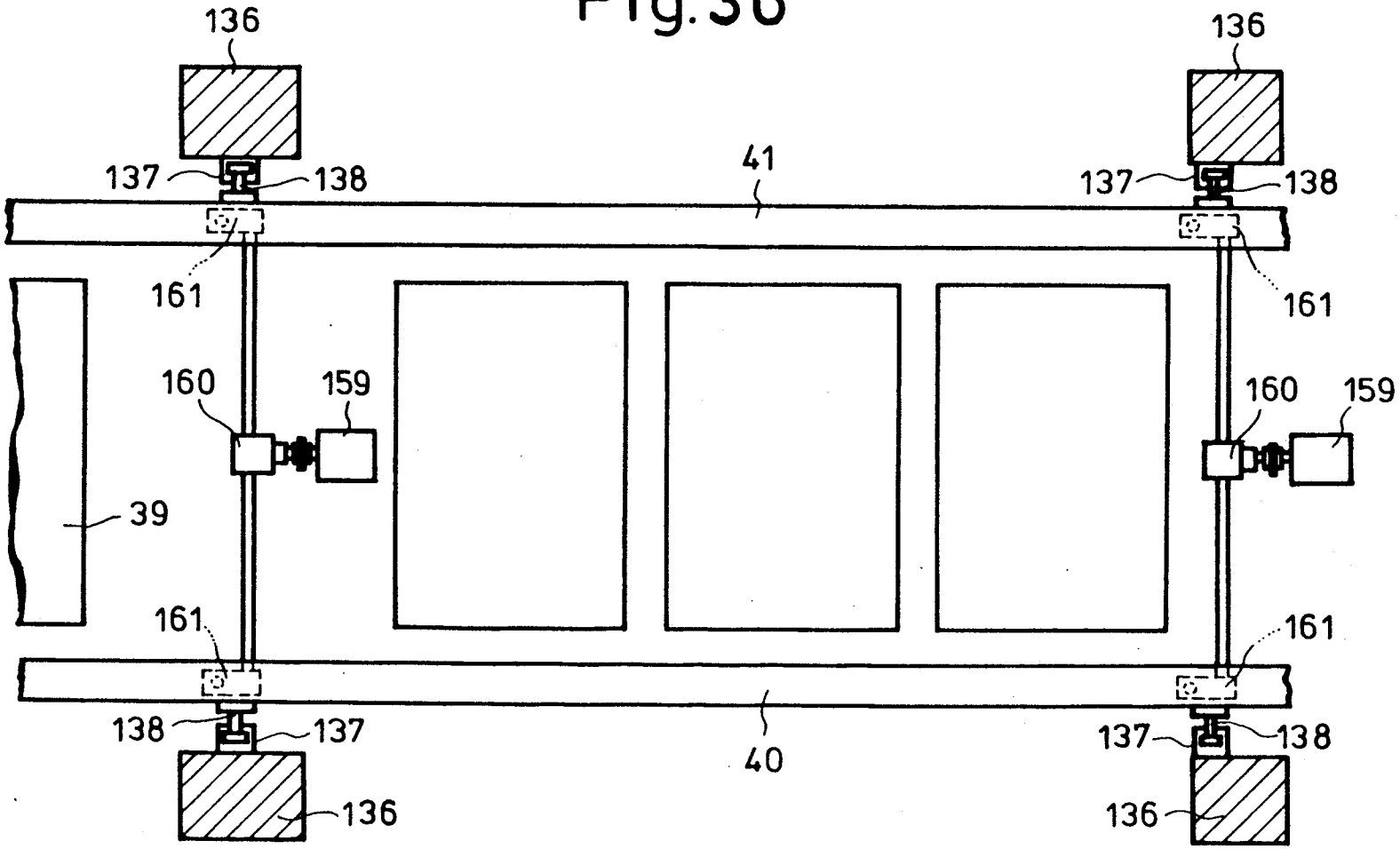
FIG. 36 is a plan view of a first modification of the fifth embodiment.
Figure 37:
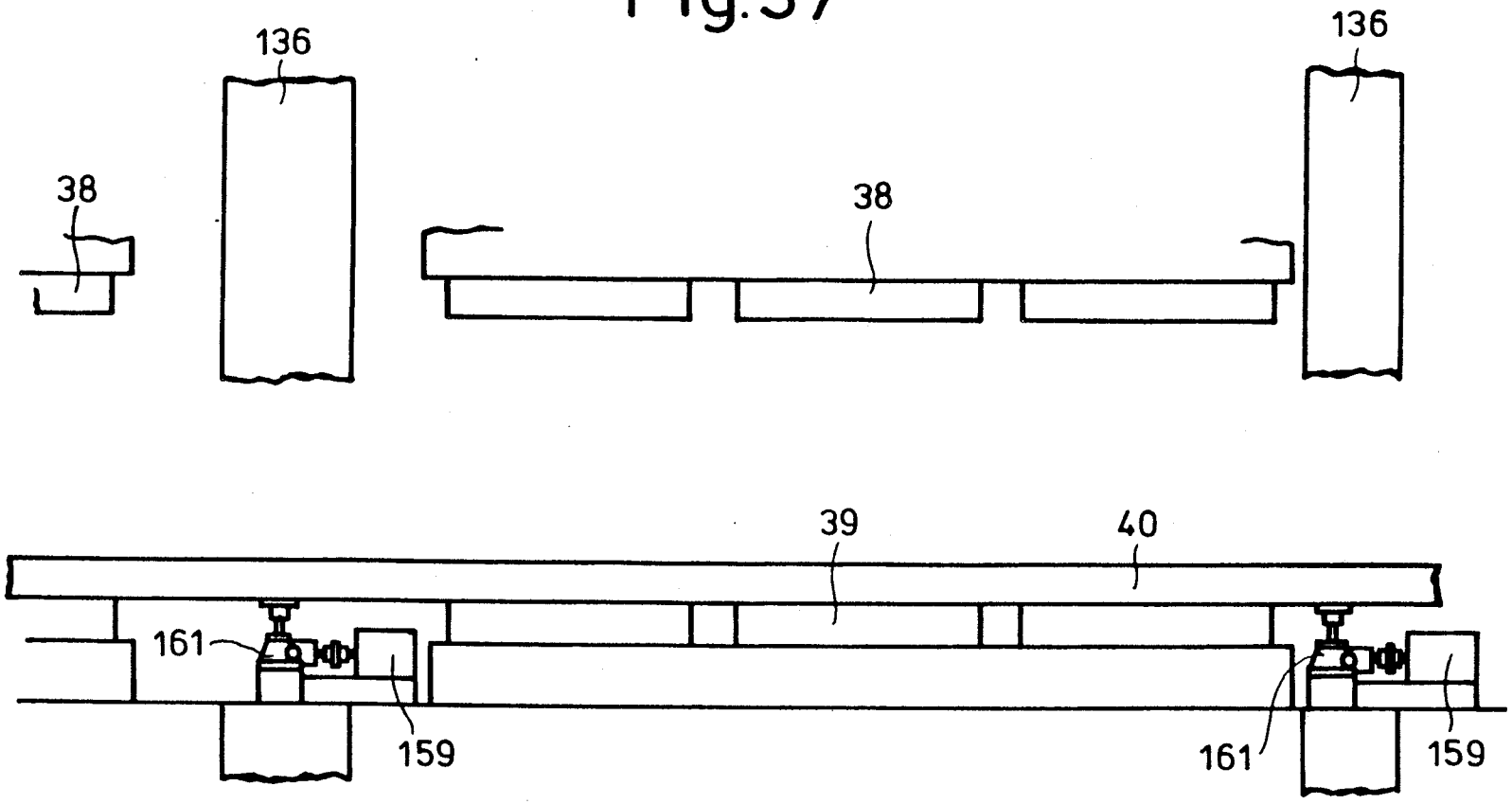
FIG. 37 is a side view thereof.

FIGS. 36 and 37 show a first modification of the fifth embodiment in which, instead of the cylinders in the fifth embodiment, jacks 161 are employed as the height adjusting means which are driven by motors 159 and gearings 160. This modification can attain the same effects and features as the fifth embodiment.

Figure 38:
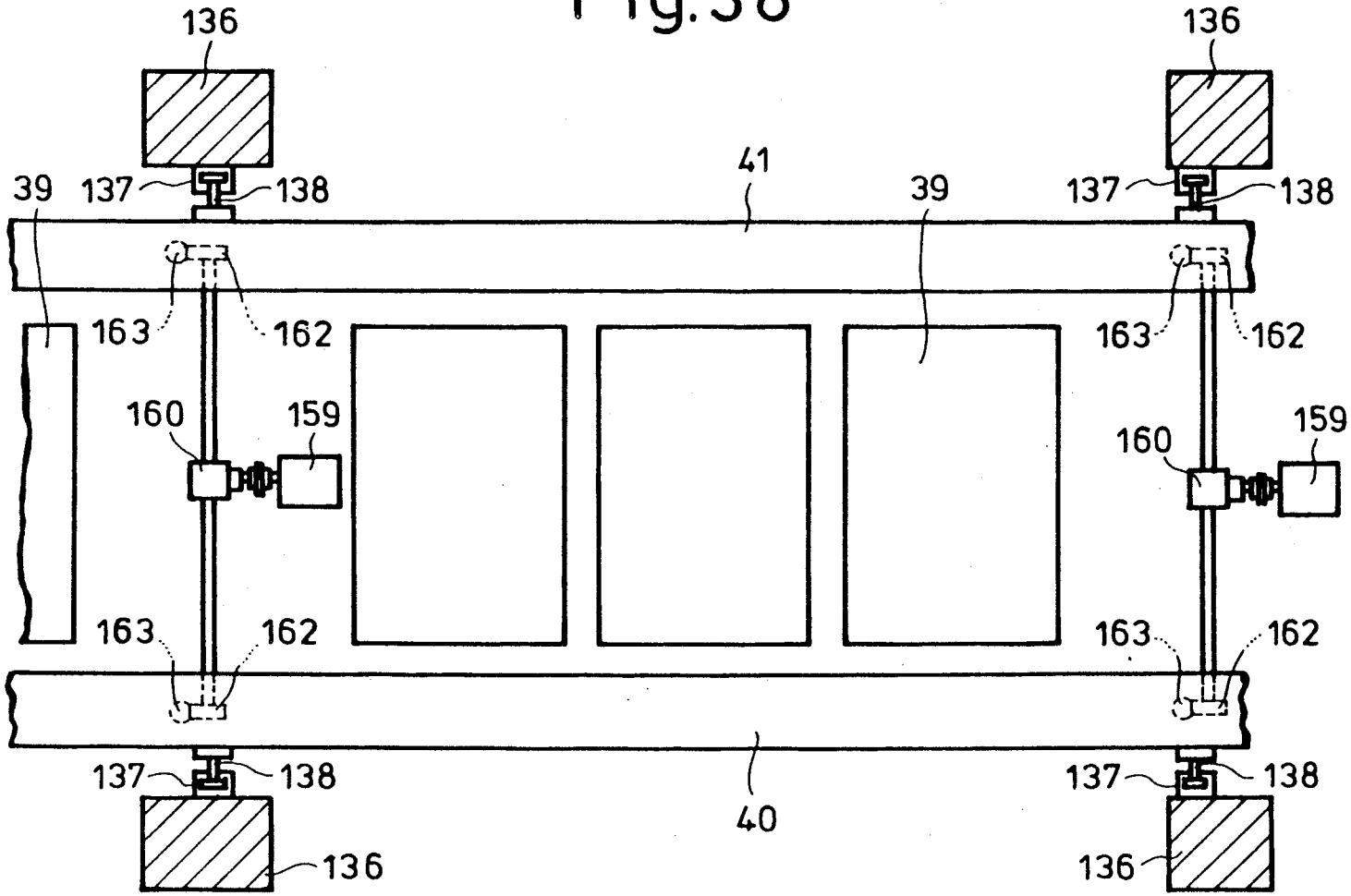
FIG. 38 is a second modification of the fifth embodiment.
Figure 39:
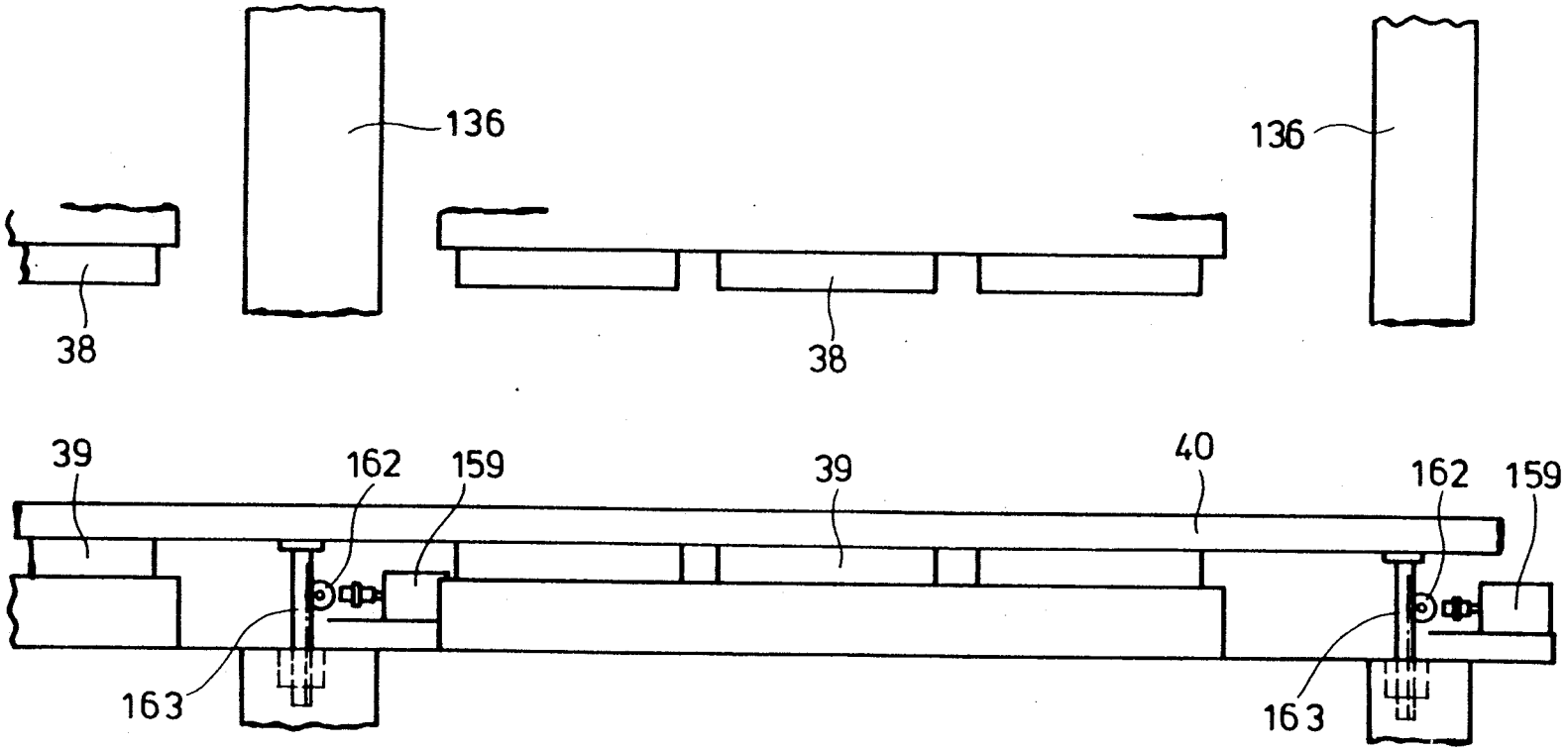
FIG. 39 is a side view thereof.

FIGS. 38 and 39 show a second modification of the fifth embodiment which employs pinions 162 and vertically extending racks 163 in mesh with said pinions 162, instead of the jacks in the first modification of the fifth embodiment. The pinion 162 is connected to the gearing 160 while the rack 163 is connected at its upper end to the corresponding guide 40 or 41. The second modification can also attain the same effects and features of the fifth embodiment.

It is to be understood that the present invention is not limited to the above-described preferred embodiments and their modifications and that further various modifications may be effected within the spirit and true scope of the present invention. For instance, the transfer devices and the driving systems of the above-described embodiments and their modifications in accordance with the present invention may be combined in various manners. Number of the work supporting means may be three or more.

What is claimed is:

1. A transfer device for transfer presses comprising a pair of parallel guides extending in the direction of a processing line on both sides of an array of press die assemblies, said guides being adapted to be maintained stationary at least during the transfer of a work, a plurality of paired trolleys, each pair of trolleys on one side of the press die assemblies being cooperatively interconnected to an opposite pair of trolleys on the opposite side of the press die assemblies and spaced apart from each other by a distance substantially equal to that between the adjacent die assemblies, said paired trolleys being in two trains for each side of the press die assemblies said two trains of paired trolleys being reciprocably movable along each guide in the direction of said processing line, single work supporting means vertically movably mounted above opposing paired trolleys, and work holding means attached to said single work supporting means.

2. A transfer device for transfer presses comprising a pair of parallel guides extending in the direction of a processing line on both sides of an array of press die assemblies, said guides being adapted to be maintained stationary at least during the transfer of a work, a plurality of trolleys interconnected and spaced apart from each other by a distance substantially equal to that between the adjacent die assemblies and reciprocably movable along each guide in the direction of said processing line, a cross bar having a longitudinal axis and a shaft extending therethrough in the longitudinal axis of the cross bar, a plurality of pinions mounted on said shaft, a pair of upper and lower racks in mesh with each said pinion, and driving means for moving the upper and lower rack in opposite directions, said cross bar being vertically movably mounted on opposing trolleys, and work holding means attached to said cross bar, said work holding means being paired for said cross bar and said paired work holding means being movable toward or away from each other in the direction of said processing line.

3. A driving system for driving a transfer device for transfer presses said transfer device comprising a pair of parallel guides, each parallel guide having a beginning and an end extending in a direction of a processing line on both sides of an array of press die assemblies, said guides being adapted to be maintained stationary at least during the transfer of a work, trains of trolleys arranged in two trains on each side of the press die assemblies, said trolleys interconnected and spaced apart from each other by a distance substantially equal to that between adjacent die assemblies, said trains of trolleys being independently reciprocally movable along each guide in the direction of said processing line, work supporting means vertically movable on each trolley, and work holding means attached to each work supporting means, said trolleys including at least an upstream and a downstream trolley located at the beginning or the end of the parallel guide, respectively, said upstream or downstream trolley comprising:

a transfer bar for reciprocally moving the trolleys in the direction of the processing line, said transfer bar being integrally connected to the trolley at one end, and having a rack at an opposite end;

a lift bar reciprocally moving in the direction of the processing line for vertically moving the work supporting means, said lift bar slidably extending through the trolley and having a first rack inside the trolley and a second rack at the opposite end;

a first pinion in mesh with the first rack of the lift bar;

a vertical rack vertically extending through the trolley beyond the top thereof said vertical rack being in mesh with the first pinion;

a guide plate securely joined to the upper end of the vertical rack such that said guide plate is vertically movable with the reciprocal motion of the lift bar;

a distance adjustment bar reciprocally moving in the direction of the processing line, said distance adjustment bar slidably extending through the trolley and having a first rack inside the trolley and a second rack at the opposite end;

a second pinion rotatably mounted within the trolley and in mesh with the first rack of said distance adjustment bar;

a horizontal rack mounted within the trolley and in mesh with the second pinion;

a first and a second supporting stands mounted on the guide plate and movable in the direction of the processing line;

a first vertical rod slidably extending through the first supporting stand at its upper end and securely joined to the horizonal rack at its lower end;

a second vertical rod slidably extending through the second supporting stand at its upper end and securely joined to said distance adjustment bar at its lower end;

said driving system comprising:

driving means for moving said distance adjustment bar such that when said distance adjustment bar moves in the direction of the processing line said supporting means move toward and away from each other;

driving means for moving said transfer bar such that all said interconnected trolleys are reciprocated in the direction of the processing line;

driving means for moving said lift bar reciprocally in the direction of the processing line such that said guide plate moves vertically and in unison with said lift bar.

4. A driving system for driving a transfer press according to claim 3, wherein the driving means are motors each having a drive shaft and a pinion; each said pinion separately in mesh with the second rack of the distance adjustment bar, the rack of the transfer bar, and the second rack of the lift bar, respectively; and the work supporting means are a crossbar.

* * * * *

UNITED STATES PATENT AND TRADEMARK OFFICE

CERTIFICATE OF CORRECTION

PATENT NO. : 5,072,823

DATED : December 17, 1991

INVENTOR(S) : Yoshio Takahashi et al.

It is certified that error appears in the above-identified patent and that said Letters Patent is hereby corrected as shown below:

Title page, item

[30] Foreign Application Priority Data

| | | |
|---|---|---|
| Oct. 31, 1987 [JP] | Japan | 62-276589 |
| Nov. 13, 1987 [JP] | Japan | 62-287011 |
| Nov. 20, 1987 [JP] | Japan | 62-177370[U] |
| Nov. 20, 1987 [JP] | Japan | 62-177372[U] |
| Nov. 20, 1987 [JP] | Japan | 62-177373[U] |
| Nov. 20, 1987 [JP] | Japan | 62-293203 |
| Dec. 29, 1987 [JP] | Japan | 62-198888[U] |
| May 9, 1988 [JP] | Japan | 63-112090 |

Signed and Sealed this

Eleventh Day of May, 1993

*Attest:*

Michael K. Kirk

MICHAEL K. KIRK

*Attesting Officer*

*Acting Commissioner of Patents and Trademarks*